US011512712B2

(12) United States Patent
Blad et al.

(10) Patent No.: US 11,512,712 B2
(45) Date of Patent: Nov. 29, 2022

(54) PUMP ASSEMBLY

(71) Applicant: GRUNDFOS HOLDING A/S, Bjerringbro (DK)

(72) Inventors: Thomas Blad, Bjerringbro (DK); Peter Mønster, Banders (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 314 days.

(21) Appl. No.: 16/493,177

(22) PCT Filed: Mar. 12, 2018

(86) PCT No.: PCT/EP2018/056082
§ 371 (c)(1),
(2) Date: Sep. 11, 2019

(87) PCT Pub. No.: WO2018/166971
PCT Pub. Date: Sep. 20, 2018

(65) Prior Publication Data

US 2020/0072238 A1 Mar. 5, 2020

(30) Foreign Application Priority Data

Mar. 14, 2017 (EP) ..... 17160837

(51) Int. Cl.
*F04D 15/00* (2006.01)
*F04D 29/42* (2006.01)
(Continued)

(52) U.S. Cl.
CPC ..... *F04D 29/4293* (2013.01); *F04D 15/0005* (2013.01); *F04D 15/0022* (2013.01);
(Continued)

(58) Field of Classification Search
CPC ..... F04D 29/4293; F04D 15/0005; F04D 29/167; F04D 29/486; F04D 29/708; F04D 15/0022; F04D 15/0066
See application file for complete search history.

(56) References Cited

U.S. PATENT DOCUMENTS 5,924,432 A * 7/1999 Thies ..... A47L 15/23 134/56 D
6,257,177 B1 * 7/2001 Lehmann ..... F01P 5/10 123/41.41
(Continued)

FOREIGN PATENT DOCUMENTS

CH 463 896 A 10/1968
DE 1 958 277 B1 2/1971
(Continued)

*Primary Examiner* — Christopher Verdier
*Assistant Examiner* — Andrew J Marien
(74) *Attorney, Agent, or Firm* — McGlew and Tuttle, P.C.

(57) ABSTRACT

A pump assembly includes at least one rotatingly driven impeller (14) and at least one valve element (18) which is rotatable about a rotation axis (X) between at least two switching positions. The valve element (18) includes a first face side (22) which extends transversely to the rotation axis of the valve element. A suction opening (24), which is engaged with a suction port (26) of the impeller (14), is formed in this first face side in a central region. The first face side (22) includes a pressure surface which surrounds the suction opening (24) and is adjacent to a delivery chamber (28) which surrounds the impeller (14).

18 Claims, 25 Drawing Sheets

(51) Int. Cl.
*F04D 29/16* (2006.01)
*F04D 29/48* (2006.01)
*F04D 29/70* (2006.01)

(52) U.S. Cl.
CPC ..... *F04D 29/167* (2013.01); *F04D 29/486* (2013.01); *F04D 29/708* (2013.01)

(56) References Cited

U.S. PATENT DOCUMENTS

2016/0258340 A1* 9/2016 Klippert ..... F04D 29/22
2016/0273543 A1* 9/2016 Blad ..... F04D 29/0416

FOREIGN PATENT DOCUMENTS

DE 72 12 196 U 6/1972
DE 44 18 153 A1 11/1995
FR 1382168 * 9/1963
FR 2 074 692 A2 10/1971

* cited by examiner

PUMP ASSEMBLY

CROSS REFERENCE TO RELATED APPLICATIONS

This application is a United States National Phase Application of International Application PCT/EP2018/056082, filed Mar. 12, 2018, and claims the benefit of priority under 35 U.S.C. § 119 of European Application 17 160 837.5, filed Mar. 14, 2017, the entire contents of which are incorporated herein by reference.

TECHNICAL FIELD

The invention relates to a pump assembly with at least one rotatingly driven impeller and with a valve element which is rotatable between at least two switching positions.

TECHNICAL BACKGROUND

Circulation pump assemblies which comprise integrated valve devices, in order to be able to switch flow paths through the pump assembly are known. Such a circulation pump is known for example from DE 1 958 277. The pump assembly which is described there comprises a valve element which in a first switching position is switched such that water in a heating facility is pumped through a heating boiler and then through subsequent heating circuits and back into the heating boiler. In a second switching position, the water is merely delivered in circulation in the heating circuit. This means that here the valve element can switch between two suction branches (suction branch connections or simply suction connections).

Many different applications however are conceivable in heating facilities, in which applications one is to switch between different flow paths at the delivery side and/or suction side of a circulation pump assembly, in order for example to be able to supply different heating circuits with warm water in a targeted manner, or in which mixing valves are necessary for the temperature adjustment (control) of the heating water.

SUMMARY

With regard to this problem, it is an object of the invention to improve a pump assembly with at least one rotatingly driven impeller and with at least one valve element, to the extent that the fields of application of such a pump assembly can be broadened or such a pump assembly can be adapted in a simpler manner to different applications.

The pump assembly according to the invention comprises at least one rotatingly driven impeller which is to say it is configured as a centrifugal pump assembly. Further preferably, the pump assembly is configured as a circulation pump assembly, in particular as a heating circulation pump assembly. The pump assembly can preferably comprise an electrical drive motor. This can further preferably be configured as a wet-running electrical drive motor, in which a can or a canned pot separates the rotor space from the stator space, so that the rotor rotates in the fluid to be delivered.

The pump assembly according to the invention moreover comprises a valve device with at least one movable valve element which is rotatable about a rotation axis between at least two switching positions. The valve element comprises a first face side which extends transversely to its rotation axis. A suction opening which is in engagement with a suction port of the impeller is formed in this first face side, in the central region, so that the fluid which is delivered by the impeller enters through the suction opening into the suction port of the impeller. The valve element at its first face side moreover comprises an annular pressure surface which surrounds the suction opening and which is adjacent to a delivery chamber which surrounds the impeller. This means that the valve element is subjected to the outlet-side pressure of the impeller at this pressure surface. This configuration permits additional functionalities of the valve device or of the valve element, since the pressure of the impeller which prevails at the outlet side can be utilized for example to initiate movements of the valve element. Moreover, it is also possible to carry out delivery-side switching procedures, since the valve element faces the delivery chamber or is in connection with the delivery side. The valve element can simultaneously carry out suction-side switching or actuating functions, since the valve element via the suction opening is likewise in connection with the suction side of the impeller. According to the invention, the valve element therefore has contact to the suction side and to the delivery side, which permits various switching functions.

The rotation axis of the valve element is preferably situated in a manner aligned to the rotation axis of the impeller. This has the advantage that the valve element with its suction opening can rotate in the suction port, or the impeller with the suction port can rotate in the suction opening. This configuration moreover also permits a simple drive of the valve element via the drive motor which drives the impeller.

The impeller is preferably configured as a closed impeller in a manner such that the impeller in a region which surrounds the suction port is closed at the face side by way of a shroud. The impeller is therefore closed by the shroud in the peripheral region of the suction port, at that face side which faces the valve element. Preferably a peripheral edge of the suction port is moreover sealingly engaged with a peripheral edge of the suction opening. For this, an axially projecting collar of the suction port for example can engage into an axially projecting collar of the suction opening, or, conversely, an axially projecting collar of the suction opening can engage for example into a corresponding collar of the suction port. A defined suction region is delimited by the suction port and by the suction opening, by way of the closed configuration of the impeller, so that the suction side and the delivery side are clearly separated from one another in the region of the valve element, so that the different pressures in the suction region and in the delivery region can be utilized for switching functions and/or targeted switching functions can be carried out in the delivery region and/or in the suction region.

According to a particular embodiment of the invention, at least one pressure opening which in at least one of the switching positions of the valve element is flow-connected to at least one delivery branch of the pump assembly can be formed in the pressure surface of the valve element. A switching function can therefore be achieved at the delivery side, by way of fluid being led out of a delivery chamber which surrounds the impeller, through the valve element to the delivery branch of the pump assembly via the pressure opening. In a second switching position of the valve element, the delivery branch can be closed such that the pressure opening is no longer in flow-leading connection with the delivery branch, so that the flow path is interrupted.

The valve element is further preferably drum-shaped with a peripheral wall which extends annularly about the rotation axis, with the mentioned first face side and with a second face side which is away from the first face side in the direction of the rotation axis, by way of which peripheral wall is preferably configured in a closed manner. Here, the peripheral wall can preferably have the shape of a circular cylinder, but could also for example have a conical shape, wherein it further preferably tapers in the direction away from the impeller. It is possible to provide necessary openings for the valve functionality only in the face sides of the valve element. Alternatively or additionally however, switching openings can also be arranged in the peripheral wall, particularly if this has a conical configuration. Due to the drum-like construction, there is room for various channels or flow paths in the inside of the valve element, in order to be able to provide different switching functions.

According to a further preferred embodiment, the valve element lies opposite at least two branch openings (connection branch openings or simply connection openings) and in its inside comprises at least one connection which, depending on the positioning or the switching position of the valve element, selectively connects one of the branch openings to the suction opening or selectively connects one of the branch openings to a pressure opening in the pressure surface or at least two branch openings to one another. The valve element can be configured for the most varied of switching functionalities by way of this. A switching function and in particular a switch-over function can be realized at the delivery side in the previously described manner by way of a selective connection of one or more branch openings to a pressure opening in the pressure surface. A switching function can be carried out at the suction side of the impeller, for example a flow path can be switched between two suction-side inlets, by way of changing the switching position of the valve element, by way of the selective connection of one or more branch openings to the suction opening of the valve element. Moreover, it would also be possible to provide only a connection in the inside of the valve element, said connection in at least one switching position connecting two branch openings to one another and in another switching position being interrupted. A switching function can therefore be created independently of the flow path through the impeller. It is also conceivable to design the valve element with one or more connections such that by way of changing the switching position, it can be selectively brought into connection with the suction side or the delivery side of the impeller. Thus for example two connections can be provided, one to a pressure opening and one to a suction opening, said openings each ending in a switching opening, so that either the switching opening to the suction opening or the switching opening which is in connection with the pressure opening can be brought into connection with one and the same branch opening. This permits further functions and fields of application of the pump assembly according to the invention.

Preferably, the at least two branch openings lie opposite a peripheral wall or preferably the mentioned second face side of the valve element which is away from the impeller. The branch openings are thereby preferably formed on the inner wall of a valve and/or pump casing. If openings or switching openings are now formed in the respective peripheral wall or face side of the valve element, then these can be brought to overlap with the branch openings by way of rotating the valve element, so that a flow path is opened, or moved away from the switching openings, so that a closed wall lies opposite the branch openings, so that these are closed and the respective flow path is interrupted.

Further preferably, the suction opening of the valve element is connected to at least one suction-side switching opening and preferably to at least two suction-side switching openings, in the valve element, via a connection in the inside of the valve element, wherein the switching opening and/or switching openings is/are arranged such that they can be brought to overlap with two suction-side branch openings to a different extent depending on the positioning of the valve element. A switching function is possible by way of such an arrangement, by way of a flow path being opened when a switching opening lies opposite a branch opening, or the flow path being closed when the switching opening is moved away from the branch opening, so that the branch opening is closed by a wall of the valve element. A mixing function can moreover be achieved by way of the degree of overlapping of at least one switching opening with two branch openings being varied such that the cross-sectional ratio of the two free branch openings to one another is varied, so that flows from the two branch openings can be changed in their ratio to one another and one can mix in a different ratio.

Particularly preferably, the at least two suction-side switching openings are radially distanced to the rotation axis of the valve element to a different extent. This is particularly advantageous if the switching openings are formed in the mentioned second face side of the valve element. Two essentially annular zones with branch openings can therefore be created in the valve casing or pump casing in a manner lying opposite these switching openings, wherein each zone delivers fluid of a different temperature, said fluids then being mixed to a different extent in the described manner by way of the valve setting or valve position. This configuration is moreover advantageous if such mixing functionalities are to be realized at different angular positions of the valve element in a manner distributed over the periphery.

Preferably, at least one and further preferably several pressure openings are formed in the pressure surface of the valve element, and this opening or these openings via a connection in the inside of the valve element are connected to one or more delivery-side switching openings which are arranged in a manner such that they can each be brought to overlap with a delivery-side branch opening depending on the switching position of the valve element. Here, the delivery-side switching openings are likewise preferably situated in the second axial face side of the valve element, which is to say the face side which is away from the impeller, and/or in a peripheral surface of the valve element. Switch-over functions can be provided at the delivery side of the impeller, which is to say at the outlet side of the pump assembly, via these pressure openings and delivery-side switching openings, in order for example to selectively delivery hot water into different heating circuits. This functionality can particularly preferably be simultaneously realized with a mixing functionality at the suction side of the impeller, as has been described above.

Particularly preferably, the delivery-side switching openings are distanced radially further to the rotation axis of the valve element than the suction-side switching openings. This permits the delivery-side and the suction-side switching openings to be arranged in the same, preferably in the second face side of the valve element, so that they do not mutually disrupt their functionality.

According to a further preferred embodiment of the invention, the several delivery-side branch openings and several delivery-side switching openings are arranged in a manner such that in a first switching position of the valve element, only one delivery-side switching opening lies opposite a delivery-side branch opening, and in at least one second switching position at least two delivery-side switching openings each lie opposite a delivery-side branch opening. This means that only one flow path to one of the branch openings is opened in the first switching position, whereas two flow paths to two branch openings are opened in the second switching position. In the first switching position for example, this permits the opening of one heating circuit and in a second switching position the opening of two heating circuits. This can also be realized with more than two branch openings, wherein in the case of a plurality of branch openings, preferably as many possible switching positions of the valve element are provided such that each of the branch openings can be opened individually, wherein the other switching openings are simultaneously closed, and preferably moreover several or all switching openings can be simultaneously opened in other switching positions. Here, the arrangement is particularly preferably selected such that all possible combinations of branch openings can be simultaneously opened. This can be achieved for example by way of a suitable distribution of the switching openings and the branch openings along a circular line at certain angular positions about the rotation axis of the valve element.

Preferably, the delivery-side switching openings and delivery-side branch openings are arranged in a manner such that in each case in a special switching position of the valve element, each of the delivery-side branch openings individually lies opposite a delivery-side switching opening and preferably in at least one further switching position, several of the delivery-side branch openings each lie opposite a delivery-side switching opening. Different heating circuits can therefore be opened independently of one another and in combination if the pump assembly is applied in a heating facility as a heating circulation pump assembly.

Further preferably, the suction-side switching openings are arranged in a manner such that in each of the switching positions of the valve element, in which one or more delivery-side switching openings lie opposite a delivery-side branch opening in each case, at least one suction-side switching opening lies opposite a suction-side branch opening. By way of this arrangement, it is ensured that in every arbitrary switching position of the delivery-side switching openings, a suction-side connection to the suction opening at the first face side of the valve element and thus to the suction port of the impeller is simultaneously given via the suction-side switching openings. Further preferably, the arrangement of the suction-side and delivery-side switching openings is such that the degree of overlapping of the suction-side switching opening with the at least one suction-side branch opening can be varied by way of changing the positioning of the valve element within the switching position. This means that the switching positions are defined by the angular position of the delivery-side switching openings and delivery-side branch openings. The change of the opening degree of a suction-side flow path is then effected by way of a change of the positioning of the valve element within this switching position, by way of the valve element being able to be rotated forwards and backwards by a certain amount about an angular position which defines the switching position. Here, the delivery-side switching opening remains at least partly lying opposite the desired delivery-side branch opening. However, the flow in the region of the suction-side switching opening can be simultaneously varied by way of changing the positioning, and in particular a change of a mixing between the flow paths from two suction-side branch openings can be varied by way of changing the positioning. This means that the movement which is necessary at the suction side for changing the positioning for influencing the flow is superimposed on the movement of the valve element between the switching positions which accomplish the switching functions at the delivery side.

Particularly preferably, the suction-side switching openings are arranged in a manner such that at least one suction-side switching opening lies opposite two suction-side branch openings in each of the switching positions of the valve element. Further preferably, two suction-side switching openings can be arranged such that each switching opening lies opposite a suction-side branch opening. The arrangement is preferably of a nature such that the degree of overlapping of the suction-side switching opening or the suction-side switching openings with the suction-side branch openings can be varied by way of changing the positioning of the valve element within the switching position. This means that one of the suction-side branch openings can be released further for example and the other suction-side branch opening simultaneously closed further, so that the mixing of the fluid flows from the two branch openings can be changed. The delivery-side switching opening however simultaneously remains in the desired switching position, which is to say overlapping a desired delivery-side branch opening, so that the switching position at the delivery side of the pump assembly remains unchanged by the change of the mixing ratio. It is particularly preferable for the valve element to always be moved by a predefined angular amount between the individual switching positions, so that the set positioning of the suction-side switching openings is also retained in the new switching position, which in particular means that a mixing ration of two flows at the suction side is not influenced by a change of the switching position at the delivery side.

The valve element or the valve device in the pump assembly according to the invention is therefore preferably configured such that a change of the positioning of the valve element is effected by way of the rotation of this element in an angular range which is smaller than an angle between the switching positions. The angle between two switching positions can thus for example be 18°, whereas the angular range, in which the positioning is effected for influencing the flow at the suction side is effected in the range of +/−5° about the angular position which is defined by the switching position. An adequately large free flow cross section through the created delivery-side connection being retained in each of the possible positionings of the valve element within the switching position can be accomplished by way of suitably large designs of the delivery-side switching openings and/or of the delivery-side branch openings.

For its movement, the valve element can be coupled to a rotor of a drive motor which drives the impeller, by way of a magnetic, mechanical and/or hydraulic coupling. This permits the drive motor which also drives the impeller, to be used to move the valve element between the switching positions and preferably within the switching positions, as described beforehand, by way of smaller angular rotations. The valve element can alternatively be driven by its own actuation motor which is preferably configured as a stepper motor. The separate actuation motor and/or a coupling to the rotor of the impeller can moreover act upon the valve element via a gear, so that preferably a step-down or reduction transmission is effected between the drive and the valve element.

The applied actuation (adjusting) motor or an electrical drive motor of the pump assembly, if it is used for moving the valve element, is preferably provided with a control device which permits the actuation motor or the electrical drive motor to be controlled or regulated such that it can be rotated in the desired angular steps, in order to move the valve element in desired angle steps between the switching positions and/or the different positionings within the switching positions in the previously described manner. An additional actuation motor can preferably be controlled by the control device of the pump assembly which controls its drive motor.

The valve element or the valve device is preferably configured and arranged such that the rotation angles between the individual switching positions corresponds to a fixed, uniform angular step or a multiple of a fixed angular step. The individual switching positions can therefore lie apart for example at certain regular angles, for example 30°, 45° 18° or the like. Here, a switching position does not actually need to lie at each of these regular angular positions, but in contrast it is possible for two switching positions to lie apart by a multiple or an integer multiple of a defined, fixed angular step. If a control device is present in the previously described manner, then this is further preferably configured such that it can activate the respective motor such that the valve element can be moved in the mentioned angular steps.

Further preferably, the valve element is mounted such that it is linearly movable along its rotation axis between a bearing (contacting) position, in which the valve element bears on at least one contact surface (bearing surface), and a released position, in which the valve element is distanced to the contact surface. A non-positive fit between the valve element and the contact surface can be achieved by way of the valve element bearing on the contact surface, said non-positive fit holding the valve element in the reached angular position. The mentioned movement can preferably be achieved by way of the pressure acting upon the pressure surface at the outlet side of the impeller. A restoring element, for example in the form of a spring can be additionally provided, said restoring element subjecting the valve element to a restoring force in the counter direction, so that it is moved back into a released initial position when the pressure in the delivery chamber drops below a predefined value. Particularly preferably, the contact surface is at least one sealing surface and further preferably a sealing surface which surrounds a branch opening. By way of this configuration, one succeeds in the valve element being able to be pressed onto the sealing surfaces, in order to achieve a good sealing. Before the movement of the valve element between the switching positions or the positions within the switching positions, the valve element can be moved into its released position, in which it is preferably not in bearing contact with the sealing surfaces, so that it can be rotated more easily. If the movement into the contacting position is effected by way of the outlet-side pressure of the impeller, then preferably before the change of the switching position, the speed of the impeller is reduced or the drive motor of the pump assembly is switched off completely, in order to firstly move the valve element into its released position.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
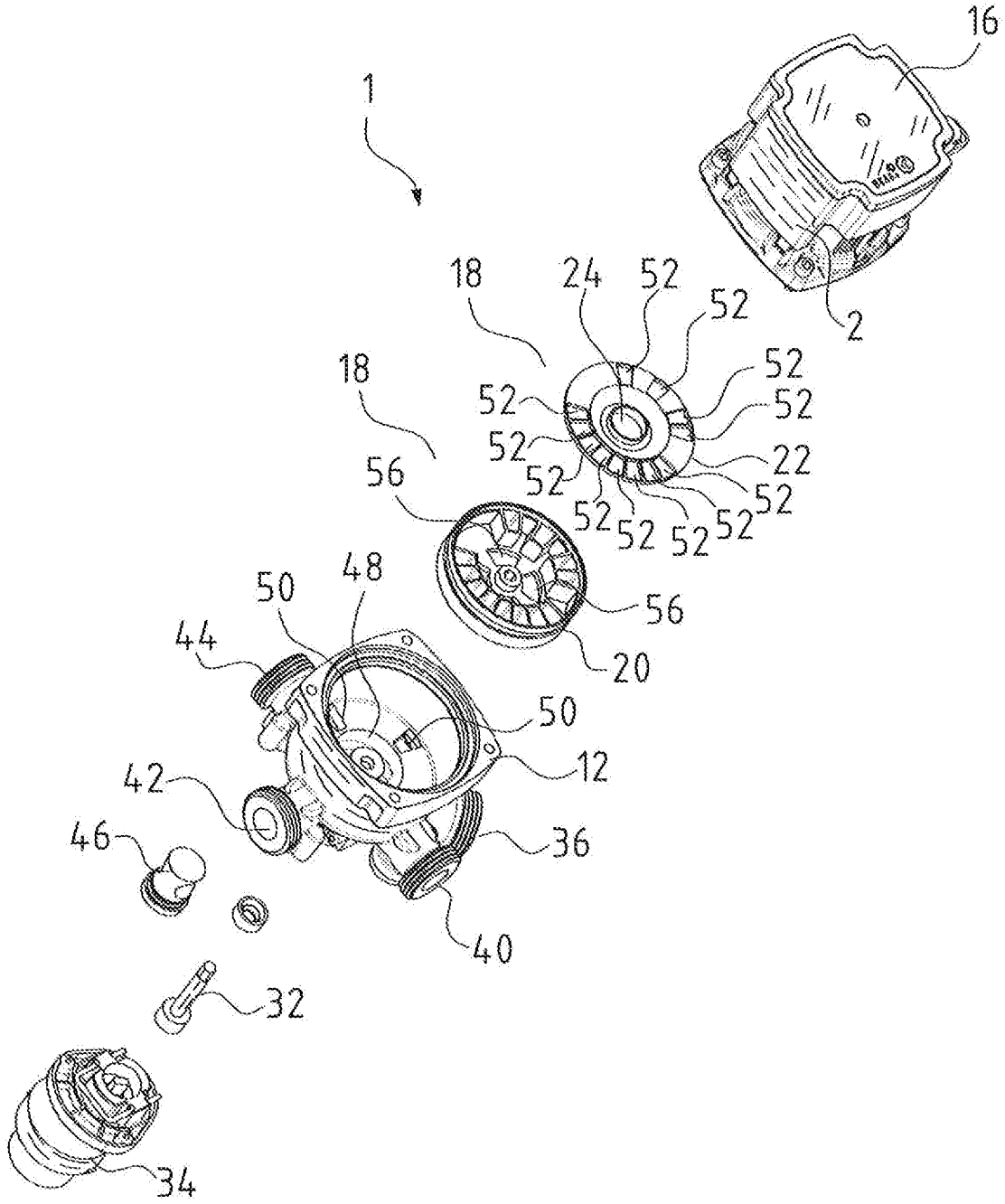
FIG. 1 is a perspective exploded view of a pump assembly according to a first embodiment of the invention.
Figure 2:
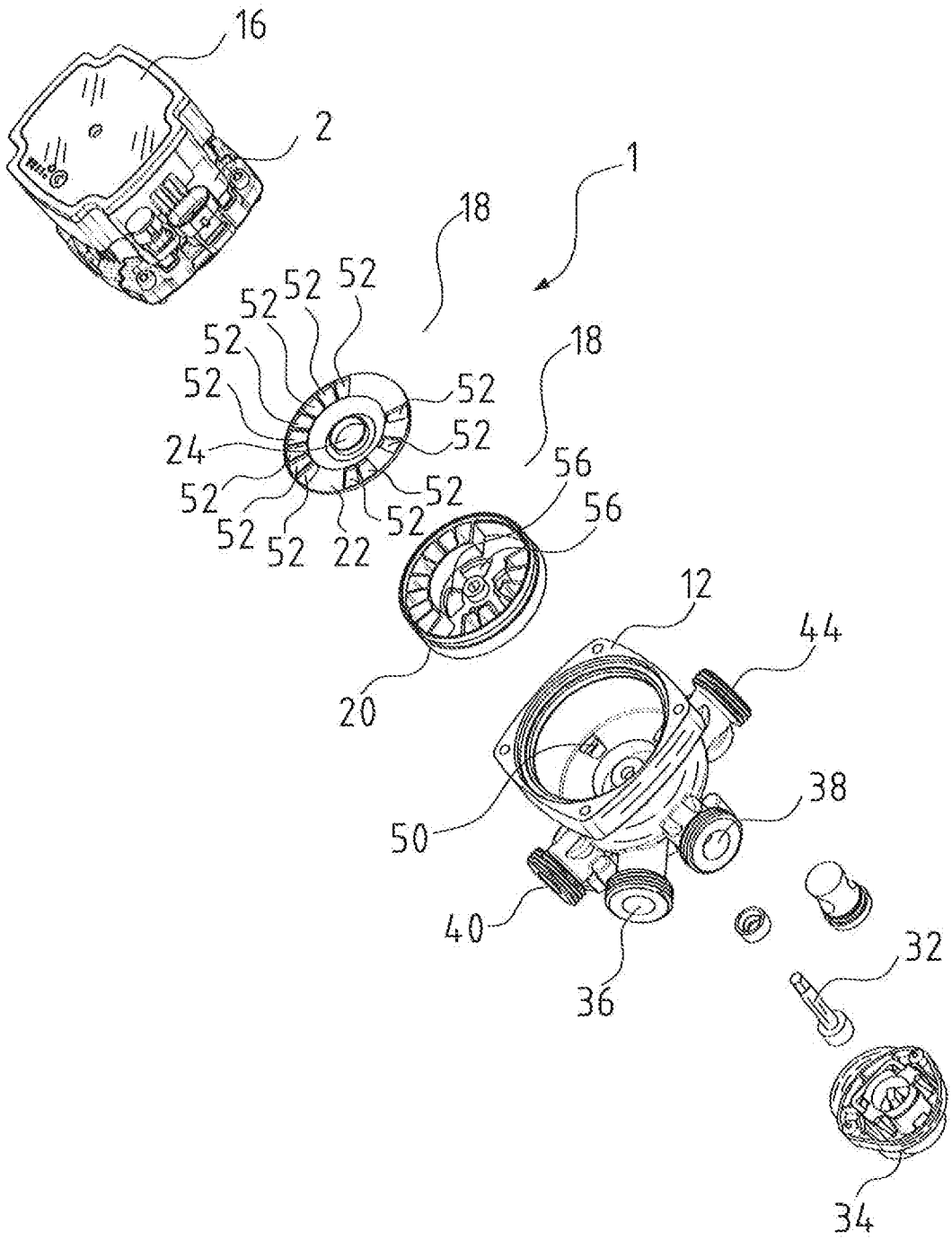
FIG. 2 is a perspective exploded view of the pump assembly according to FIG. 1 from another viewing direction.
Figure 3:
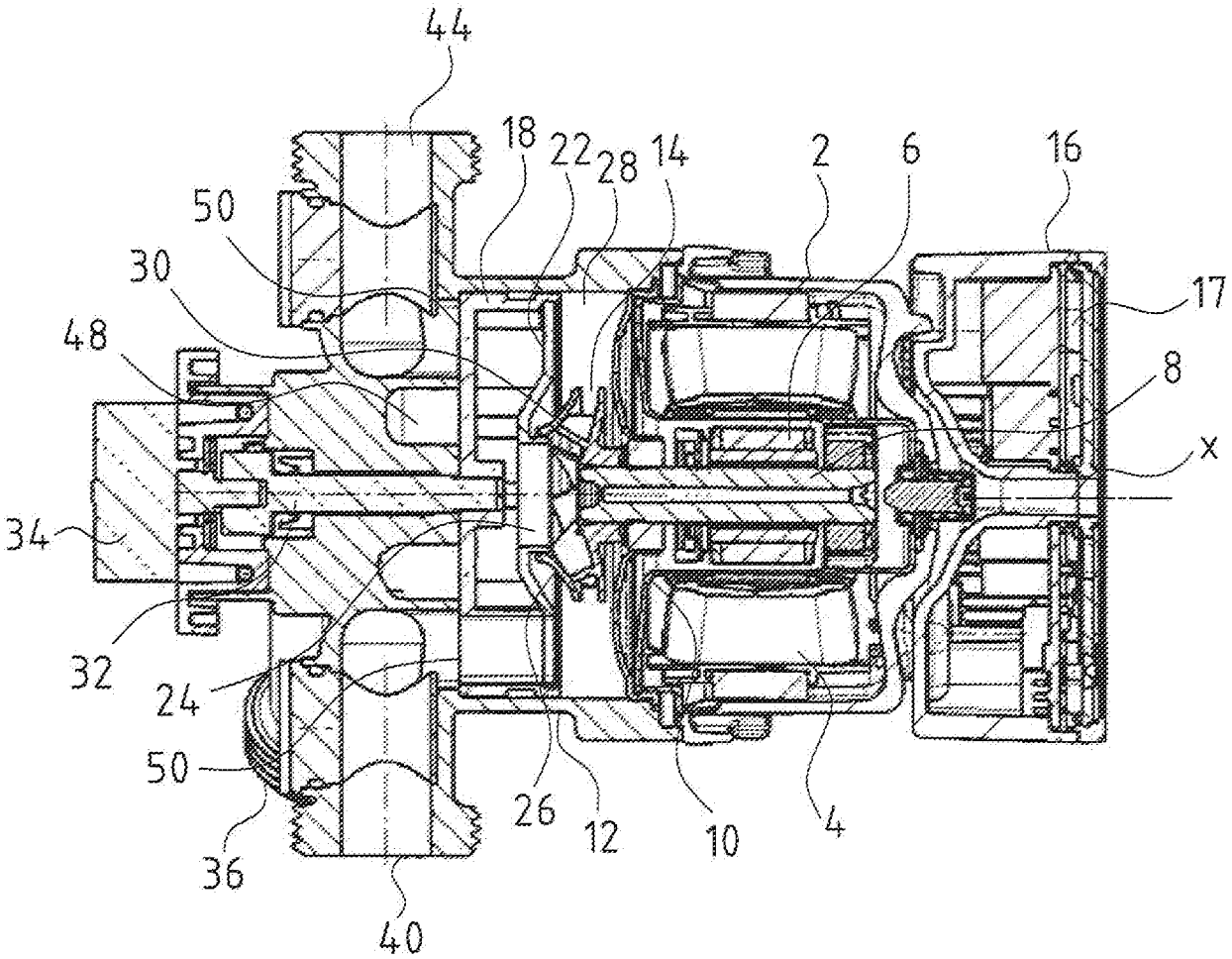
FIG. 3 is a sectioned view of the pump assembly according to FIGS. 1 and 2.
Figure 4:
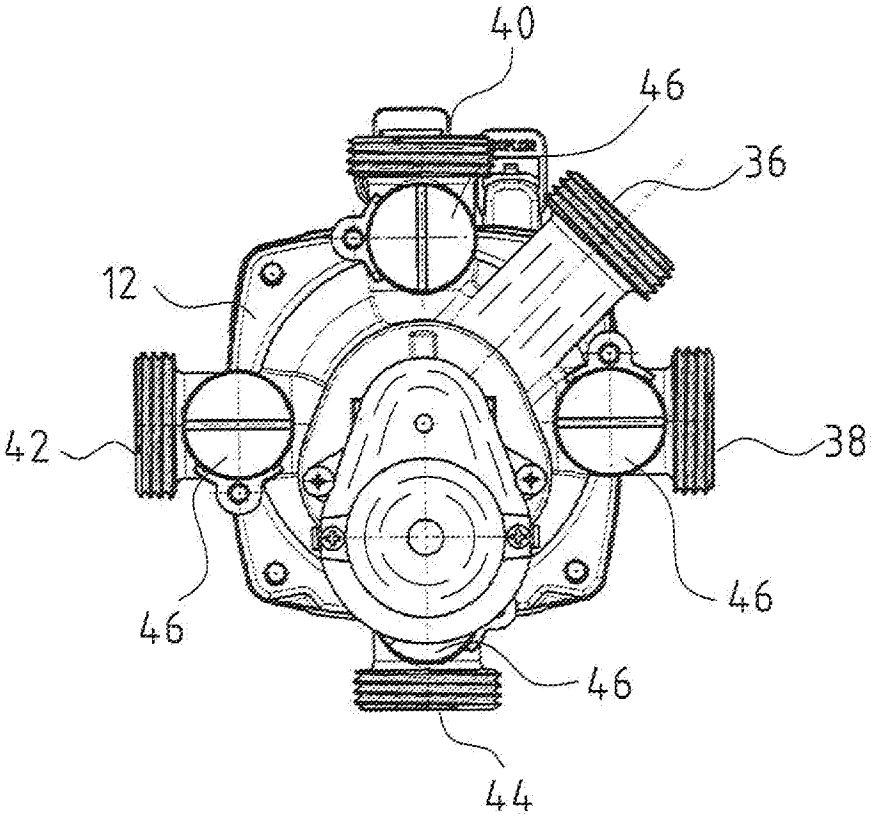
FIG. 4 is a plan view of the lower side of the pump assembly according to FIGS. 1 to 3.
Figure 5:
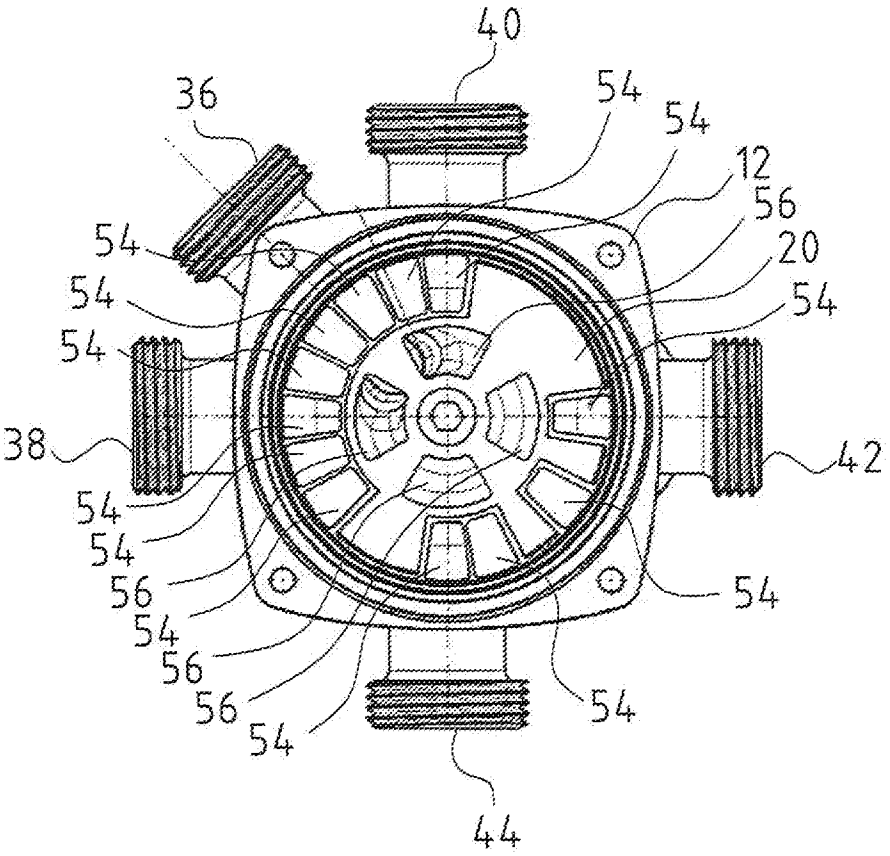
FIG. 5 is a plan view of the opened pump casing of the pump assembly according to FIGS. 1 to 4, with an opened valve element.

Referring to the drawings, a first embodiment example according to FIGS. 1 to 6 shows a pump assembly in the form of a centrifugal pump assembly, into which a valve device which permits a switching between four different heating circuits is integrated.

The centrifugal pump assembly or the pump assembly 1 comprises a stator casing or motor casing 2, in which an electrical drive motor with a stator 4 and a rotor 6 is arranged. The rotor 6 is arranged on a rotor shaft 8 in a rotationally fixed manner. The shown electrical drive motor is configured as a wet-running electrical drive motor with a can 10 or canned pot which separates the stator space with the stator 4 from the rotor space with the rotor 6 which is arranged therein, so the rotor 6 rotates in the fluid to be delivered. The motor casing 2 is connected to the pump casing 12 which simultaneously forms a valve casing. An impeller 14 which is connected to the rotor shaft 8 in a rotationally fixed manner rotates in the pump casing 12.

An electronics casing 16 with a control device 17 which is arranged therein is arranged at the axial end which is away from the pump casing 12 in the direction of the rotation axis X. The control device 17 in particular serves for the control or regulation of the electrical drive motor, wherein the electrical drive motor in particular is changeable in its speed, for which the control device 17 can comprise a frequency converter. It is to be understood that the electronics casing 16 does not necessarily need to be arranged at the axial end of the motor casing 2 but could also be arranged at another position.

Apart from the impeller 14, a valve element 18 is arranged in the pump casing 12. The valve element 18 is configured in a drum-like manner with a pot-like lower part 20 and with a cover 22 which closes the lower part 20 at its face side which faces the impeller 14. The cover 22 comprises a central suction opening 24 which is engaged with the suction port 26 of the impeller 14, wherein in this embodiment example an axially projecting collar of the suction opening 24 engages into the inside of the section port 26. The region of the cover 22 which surrounds the suction opening 24 forms a pressure surface which faces the delivery chamber 28 in the peripheral region of the impeller 14. The delivery chamber 28 is that delivery chamber, into which the fluid exits from the impeller 14, which is to say the chamber at the exit side of the impeller 14, in which chamber a greater pressure prevails than at the suction side. The valve element 18 is therefore connected to the suction side in the region of the suction opening 24 as well as to the delivery side at the delivery chamber 28, via the pressure surface formed by the cover 22.

The impeller 14 is configured in a closed manner, which is to say that it is closed by an annular shroud 30 in the peripheral region of the suction port 26 at its side which faces the valve element 18. The shroud 30 ensures the separation between the suction region and the delivery region at the impeller 14.

The valve element 18 is arranged on a shaft 32 in a rotationally fixed manner, wherein it can move on the shaft 32 by a certain amount in the axial direction X. The shaft 32 is connected to an adjusting (actuating) motor 34 which is preferably configured as a stepper motor with a step-down gear. The actuating motor 34 is likewise activated (controlled) by the control device 17.

The pump casing 12 comprises a suction branch or inlet 36 as well as four outlets or delivery branches 38, 40, 42, and 44. A regulating valve 46 is arranged in each of the delivery branches 38, 40, 42 and 44, in order to set the flow through the respective delivery branch 38, 40, 42, 44. The suction branch 36 runs out in an annular, suction-side branch opening 48 in the inside of the pump casing, said suction opening extending annularly about the rotation axis X of the rotor 6 which is simultaneously the rotation axis of the shaft 32 and thus of the valve element 18. In the inside of the pump casing, the delivery branches 38, 40, 42, 44 run out in a base surface which extends transversely to the rotation axis X, in each case in a delivery-side branch opening 50. In this embodiment example there are therefore four delivery-side branch openings 50 which are each situated at the angular positions of the delivery connections in a manner offset by 90°. Here, the delivery-side branch openings in the base of the pump casing 2 lie on an annular surface which is arranged radially outside the suction-side branch opening.

The valve element 18 in its inside comprises several, in this case twelve connections which each extend parallel to the rotation axis X from a pressure opening 52 to a delivery-side switching opening 54 at the opposite face side of the valve element 18, which is to say at the face side which is away from the impeller 14. Moreover, four suction-side switching openings 56 lying further radially inwards than the delivery-side switching openings 54 are arranged in the axial face side of the valve element 18 which is away from the impeller 14, which is to say in the base of the lower part 20. The suction-side switching openings 56 are open to the interior of the valve element 18 and are in fluid-leading connection to the suction opening 24. The connections between the delivery-side switching openings 54 and the pressure openings 52 are separated from the remaining interior of the valve element 18 by the walls, so that on the one hand delivery-side connections between the pressure openings 52 and the delivery-side switching openings 54 as well as a suction-side connection from the suction-side switching openings 56 to the suction opening 54 exist in the axial direction through the valve element.

The delivery-side switching openings 54 are arranged on the base of the valve element 18 such that they are distanced just as far from the rotation axis X as the delivery-side branch openings 50 in the base of the pump casing 12. This means that the delivery-side branch openings 50 lie on an annular region in a manner such that they lie opposite an annular region, in which the delivery-side switching openings 54 are arranged. Moreover, the delivery-side switching openings 54 and the delivery-side branch openings 50 are dimensioned in a manner matching one another, so that they can be brought to overlap by way of a suitable rotation of the valve element 18.

The suction-side switching openings 56 lie opposite the annular, suction-side branch opening 48, so that a connection from the suction branch 36 to the suction-side switching openings 56 and via this to the suction opening 34 exists.

Figure 6A:
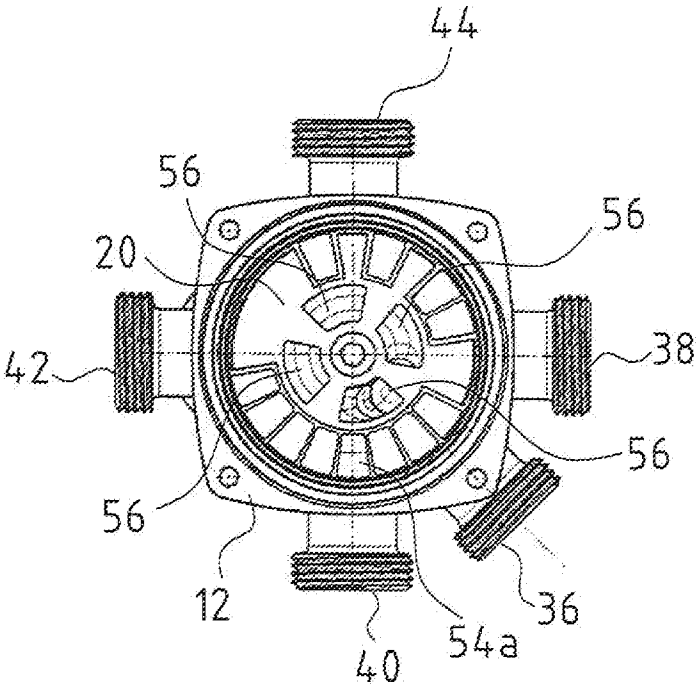
FIG. 6*a* is a view according to FIG. 5 for one of five different switching positions.
Figure 6B:
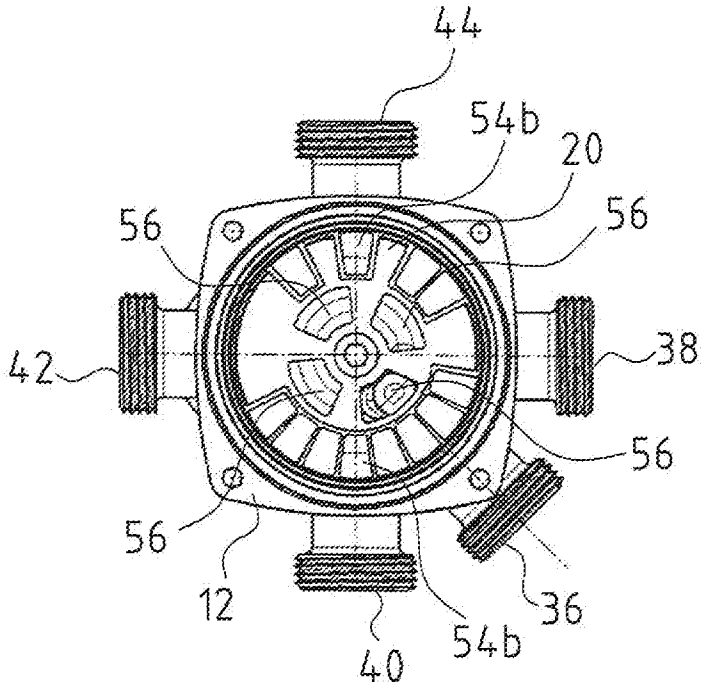
FIG. 6*b* is a view according to FIG. 5 for one of five different switching positions.
Figure 6E:
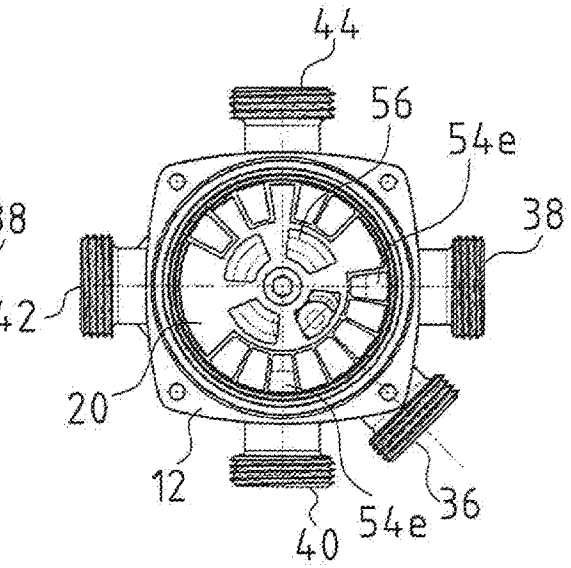
FIG. 6*e* is a view according to FIG. 5 for one of five different switching positions.
Figure 6D:
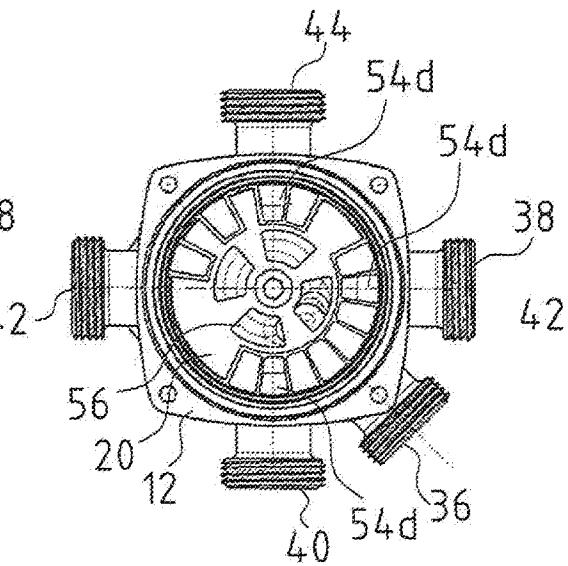
FIG. 6*d* is a view according to FIG. 5 for one of five different switching positions.
Figure 6C:
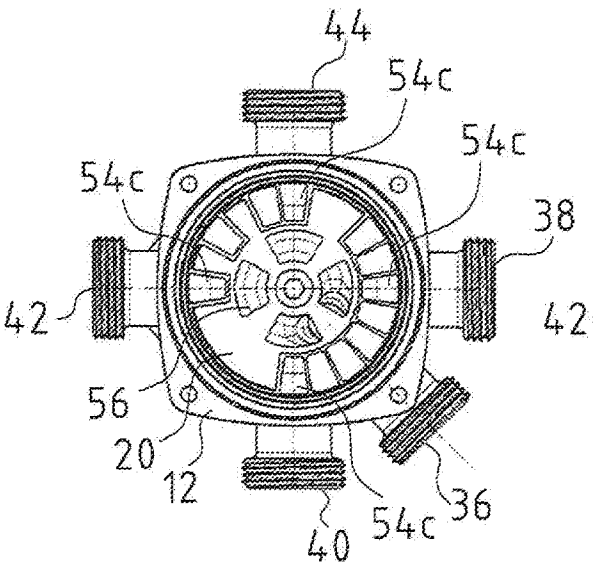
FIG. 6*c* is a view according to FIG. 5 for one of five different switching positions.
Figure 7:
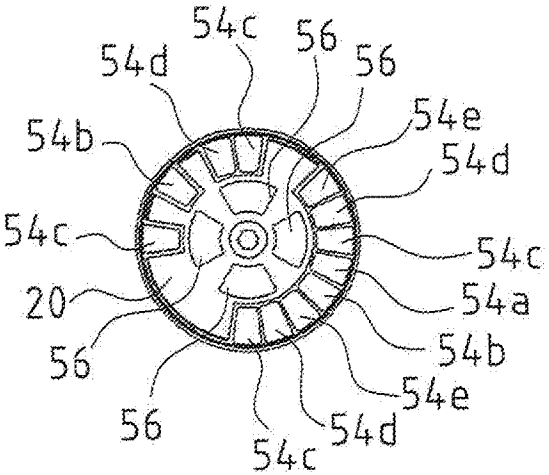
FIG. 7 is a plan view of the opened valve element.
Figure 8:
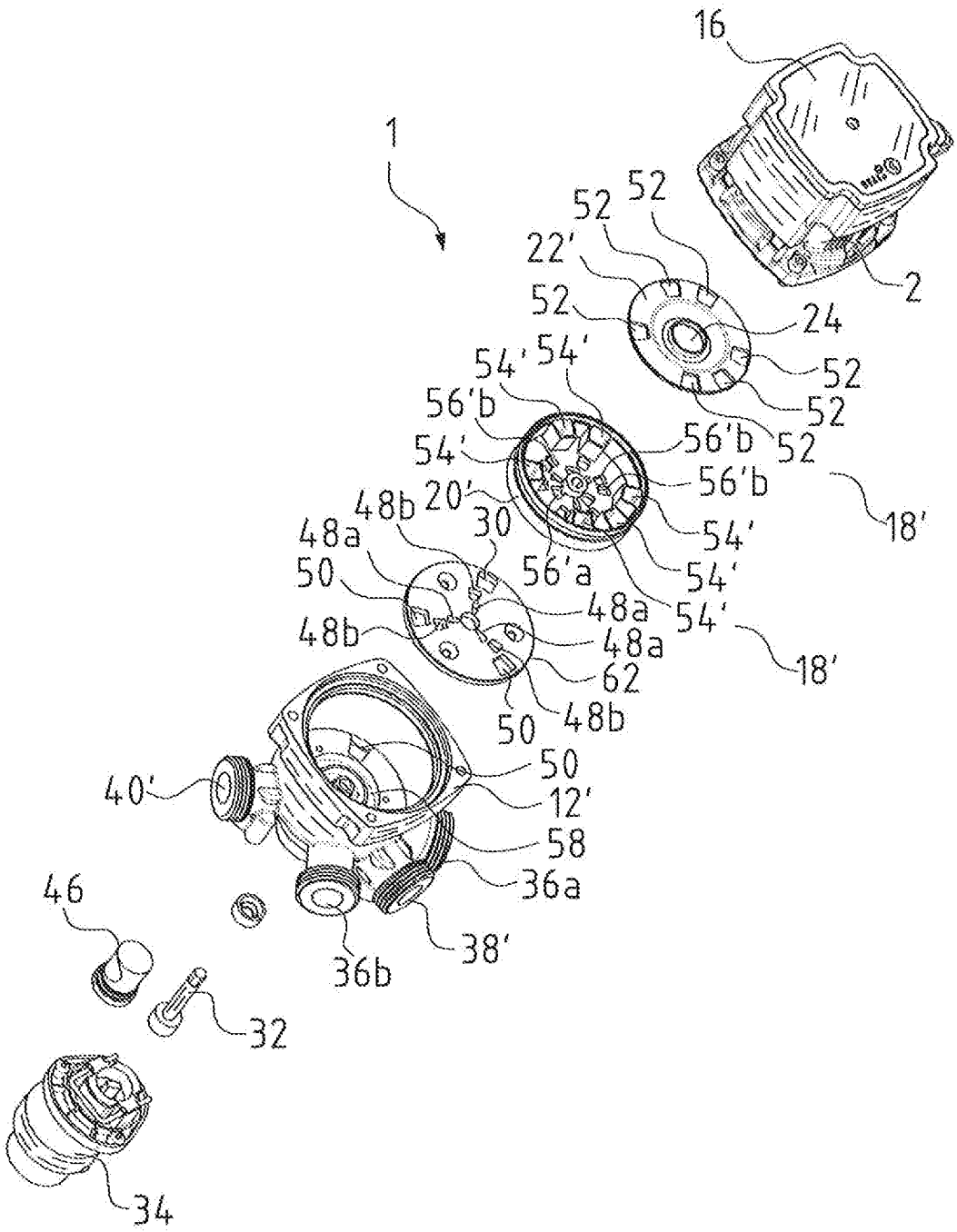
FIG. 8 is a perspective exploded view of a pump assembly according to a second embodiment of the invention.
Figure 9:
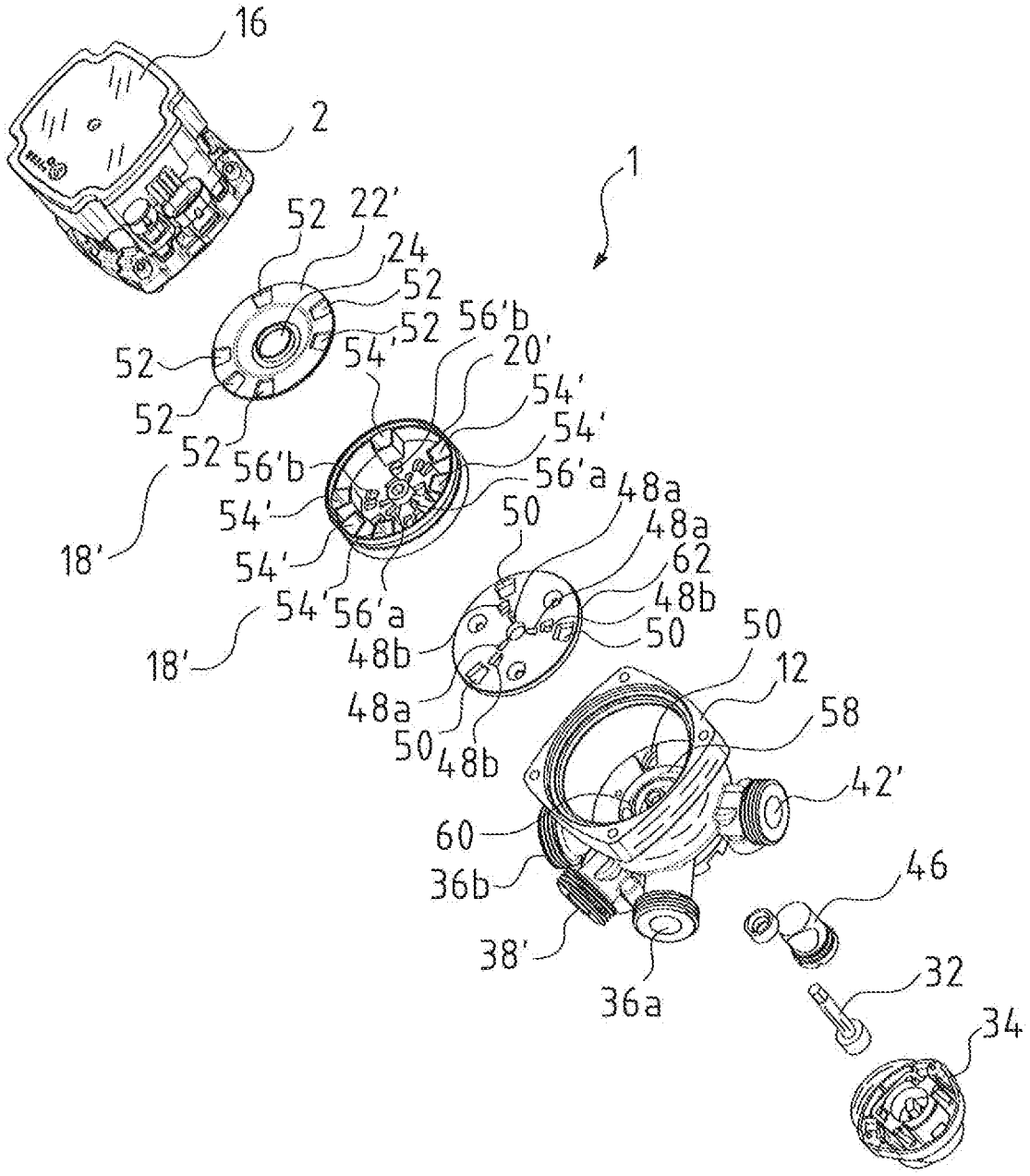
FIG. 9 is a perspective exploded view of the pump assembly according to FIG. 8 from a different viewing direction.
Figure 10:
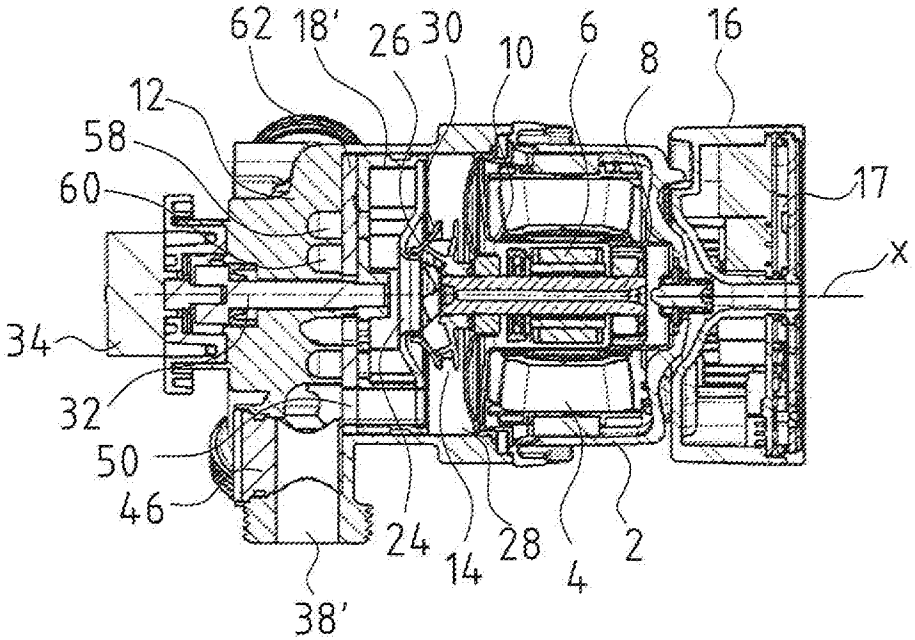
FIG. 10 is a sectioned view of the pump assembly according to FIGS. 8 and 9.
Figure 11:
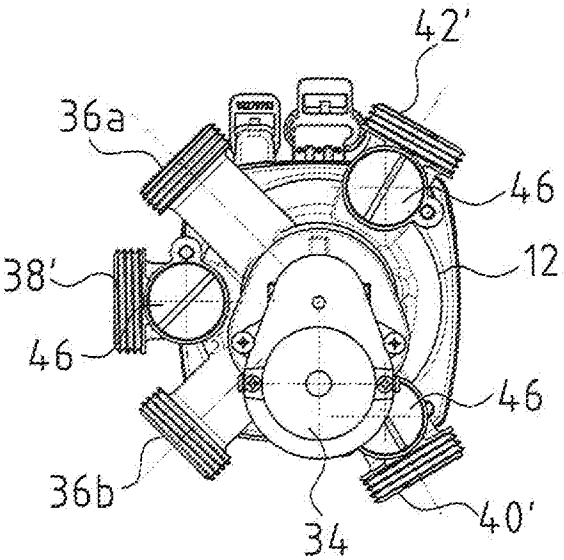
FIG. 11 is a plan view of the lower side of the pump assembly according to FIGS. 8 to 10.

Five different switching positions are now explained by way of FIGS. 6*a* to 6*e* and FIG. 7. FIG. 6*a* shows a first switching position, in which only a delivery branch 40 is opened or connected to the delivery chamber 38. For this, the valve element 18 is rotated such that the delivery-side switching opening 54*a* lies congruently to the delivery-side branch opening 50 which is connected to the delivery branch 40. In contrast, all other delivery-side switching openings 54 in the lower part 20 of the valve element 18 lie opposite the base regions of the pump casing 12. In particular, the remaining delivery-side branch openings 50 are covered and closed by the base of the lower part 20. The suction-side switching openings 56 are in connection with the suction-side branch opening 48, so that in this switching position the impeller 14 delivers fluid through the suction branch 36 towards the delivery branch 40. In the second switching position according to FIG. 6*b*, two delivery side switching openings 54*b* which are arranged diametrically opposite one another are situated congruently to the delivery-side branch openings 50 of the delivery branches 40 and 44, so that the pump assembly delivers from the suction branch 36 into the opened outlets 40 and 44. In the same manner, a connection to the outlets 38 and 42 could be created by way of the delivery-side switching openings 54*b* being brought to overlap with the delivery-side branch openings 50 of the delivery branches 38 and 42 by way of rotating the valve element 18 by 90°. In the third switching position which is shown in FIG. 6*c*, all four delivery branches 38, 40, 42, 44 are opened, by way of the four delivery-side switching openings 54*c* which are arranged offset to one another by 90° being brought to overlap with the four delivery-side branch openings 50 by way of a corresponding angular position of the valve element 18. The impeller 14 therefore delivers into all four delivery branches.

FIG. 6*d* shows a further switching position, in which only three of the delivery branches 38, 40, 42 and 44, specifically the three delivery branches 38, 40 and 44 are opened. In this switching position or angular position of the valve element 18, the three delivery-side switching openings 54*d* are brought to overlap with the delivery-side branch openings 50 of the delivery branches 38, 40 and 44. For this, the three delivery-side switching openings 54*d* are each arranged offset to one another by 90°, so that no delivery-side switching opening is formed in the lower part 20 at the associated fourth 90° position and the fourth remaining delivery-side branch opening 50 is therefore covered and closed by the base of the lower part 20 at this location. It is to be understood that the three other possible combinations of opening three of the delivery branches 38, 40, 42 and 44 in each case could also be realized via the delivery-side switching openings 54*d* by way of rotating the valve element 18 about 90° in each case.

FIG. 6*e* shows a further switching position, in which two delivery branches which lie next to one another are simultaneously opened. For this, two further delivery-side switching openings 54*e* which are offset to one another by 90° are formed in the valve element 18. Here too, no corresponding delivery-side switching openings are formed in the lower part 20 at the two remaining associated 90° angular positions, so that the two remaining delivery-side branch openings 50 are closed in this position. In the switching position which is shown in FIG. 6*e*, the delivery-side switching openings 54*e* lie above the delivery-side branch openings 50 of the delivery branches 38 and 40. The opening of three other possible combinations of delivery branches lying next to one another can be opened via the delivery-side switching openings 54*e* by way of rotating the valve element 18 by 90° in each case. It is to be recognized that all possible combinations of the four delivery branches 38, 40, 42, 44 being able to be opened individually and in combination can be realized by way of a suitable angular position of the valve element 18. A very simple distribution valve is therefore created, which only requires a single drive and can moreover be integrated directly into the pump casing 12. In the shown example, the switching openings 54 are arranged in a pattern of 18° steps, so that the different switching positions can be changed by way of rotating the valve element 18 in steps of 18° or a multiple of 18°.

When the pump assembly is in operation and delivers fluid, the pressure prevailing in the delivery chamber 38 moreover has the effect that a pressing force which presses the valve element 18 against the base of the pump casing 12 is produced upon the pressure surface on the cover 22, so that a sealed bearing contact occurs in the peripheral region of the delivery-side branch openings 50 and good sealing can therefore be ensured. In particular, a sealing between the suction side and delivery side, which is to say between the delivery-side branch openings 50 and the suction-side branch opening 48 can hence be created.

The second embodiment according to FIGS. 8 to 15 differs from the previously described embodiment in that only three delivery-side circuits or branches can be supplied, but a mixing valve is additionally integrated into the pump assembly.

In this embodiment example, the pump casing 12 comprises two suction branches 36*a* and 36*b*. Moreover, three delivery branches 38', 40' and 42' which in the inside of the pump casing 12 run out into three delivery-side branch openings 50 which are each arranged offset to one another by 120 are arranged on the pump casing 12. In the base of the pump assembly 12, the suction branch 36*a* is in connection with an outer annular opening 58, whereas the suction branch 36*b* is in connection with an inner annular opening 60. In this embodiment, a cam disc 62 is arranged in the base of the pump casing 12 and lies at a fixed angular position, so that openings which form the delivery-side branch openings 50 lie opposite the delivery-side branch openings 50 in the base of the pump casing 12'. Moreover, three suction-side branch openings 48*a* which are in connection with the suction branch 36*a* by way of them lying opposite the inner annular opening 60 are arranged in the cam disc in a manner lying radially inwards. Three suction-side branch openings 48*b* are arranged further radially outwards and opposite the outer annular opening 58, at three angular positions which are distributed uniformly over the periphery. These suction-side branch openings 48*b* are in connection with the suction branch 36*b*.

The valve element 18' is constructed in a similar manner to the valve element 18 according to the first embodiment, but in this embodiment example only six connection run between six pressure openings 52 in the pressure surface which is formed by the cover 22' and six delivery-side switching openings 54'. Suction-side switching openings 56'*a* and 56'*b* are moreover arranged on the base of the lower part 20', wherein the suction-side switching openings 56'*a* in a manner lying radially inwards lie at a radial position which corresponds to the positioning of the suction-side branch openings 48*a*. The suction-side switching openings 56'*b* are arranged lying radially further outwards in an annular region which lie opposite an annular region, in which the suction-side branch openings 48*b* are situated. In these examples, the delivery-side switching openings are arranged in a pattern of 20° steps, so that angular steps of 20° or a multiple of 20° result between the switching positions. The remaining construction of the pump assembly corresponds to the construction of the pump assembly according to the first embodiment example, so that the description regarding this is referred to.

Figure 12A:
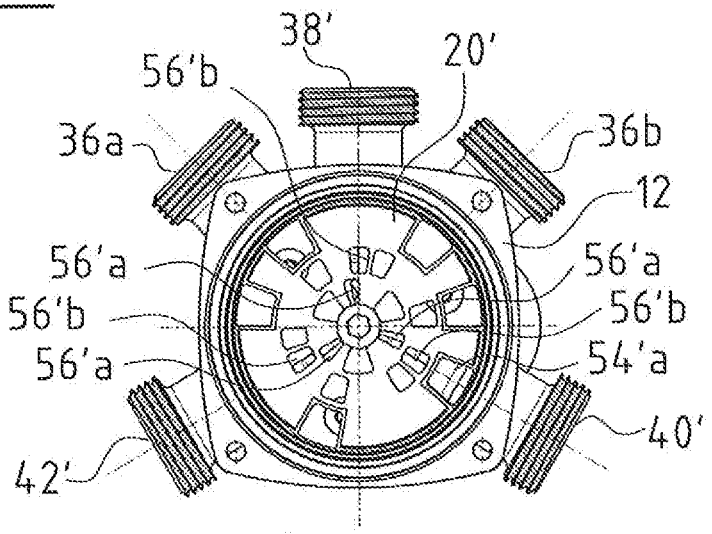
FIG. 12*a* is a plan view of the opened pump casing with an opened valve element for one of three different switching positions, in which an outlet is opened.
Figure 12B:
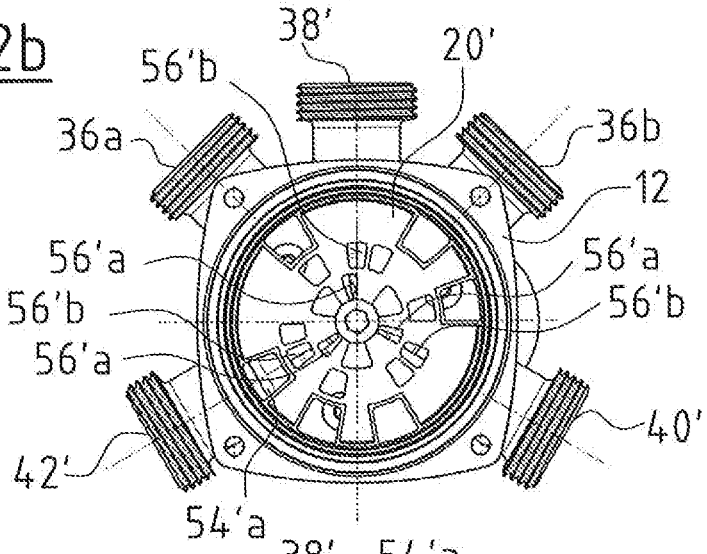
FIG. 12*b* is a plan view of the opened pump casing with an opened valve element for one of three different switching positions, in which an outlet is opened.
Figure 12C:
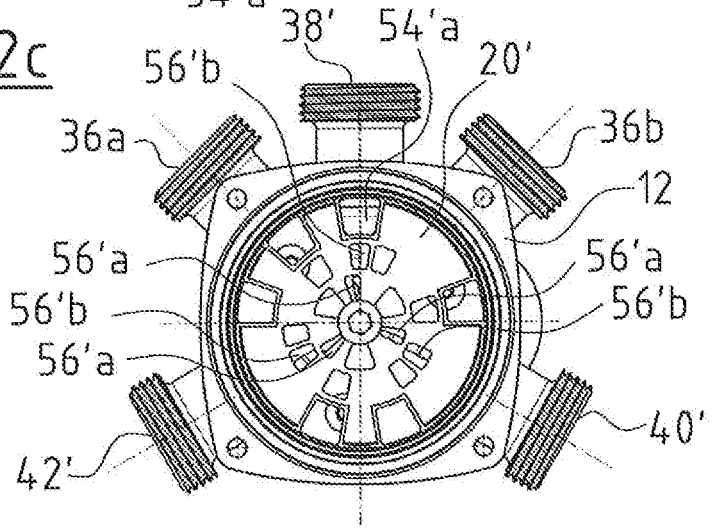
FIG. 12*c* is a plan view of the opened pump casing with an opened valve element for one of three different switching positions, in which an outlet is opened.

Three switching positions, in which one of the delivery branches 38', 40' and 42' is opened, are represented by way of FIGS. 12*a* to 12*c*. In FIG. 12*a*, the delivery branch 40' is opened by way of the delivery-side switching opening 54'*a* lying opposite a delivery-side branch opening 50 which is connected to the delivery branch 40'. The delivery-side switching opening 54'*a* is situated in the base of the lower part 20' of the valve element 18' such that taking the delivery-side switching opening 54'*a* as a starting point, there are no switching openings distanced by 120° in each case, so that the other two delivery-side branch openings 50 are covered by the base of the lower part 20' and thus closed in this valve position or switching position. The valve element 18' is rotated by 120° in the switching position according to FIG. 12*b*, so that the delivery-side switching opening 54'*a* lies opposite the pressure opening which is connected to the delivery branch 42'. FIG. 12*c* shows a third switching position, in which the valve element 18' is rotated once again by 180° about the rotation axis X, so that the delivery-side switching opening 54'*a* lies opposite the delivery-side branch opening 50 which is connected to the delivery branch 38'. The valve element 18 can moreover be slightly changed in its position by a small angular range (e.g. +/−5°) in each of these three mentioned switching positions, so that the oppositely lying suction-side branch openings 48*a* can be slightly changed in their overlapping, so that the flow can be increased or reduced. The suction-side switching openings 56'*b* are simultaneously slightly varied in their overlapping with the suction-side branch openings 48*b*, so that the flow can be changed here also. Here, the change of the overlapping can be effected such that when the free cross section of the suction-side branch openings 48*a* is enlarged, the free cross section of the suction-side branch openings 48*b* is simultaneously reduced. The mixing ratio of the flows which flow through the suction-side branch openings 48*a* and 48*b* can be changed in this manner. It is to be recognized that such a mixing by way of a slight change of the positioning within the switching position is possible in all three switching positions shown in FIG. 12*a*, FIG. 12*b* and FIG. 12*c*. However, the mixing ratio stays the same if the switching position is changed by a rotation about 120°, since, due to the arrangement of the suction-side switching openings 56', the degree of overlapping with the suction-side branch openings 48*a* and 48*b* is not changed.

Figure 13A:
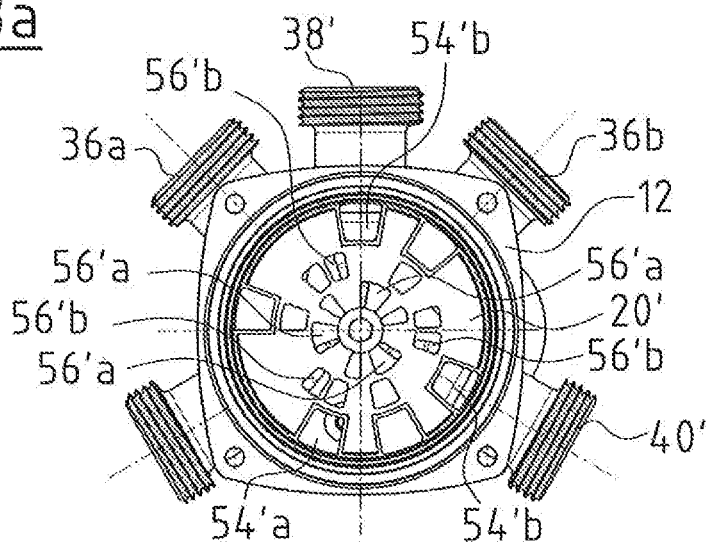
FIG. 13*a* is a view according to FIGS. 12*a* to 12*c* for one of three different switching positions, in which two outlets are opened.
Figure 13B:
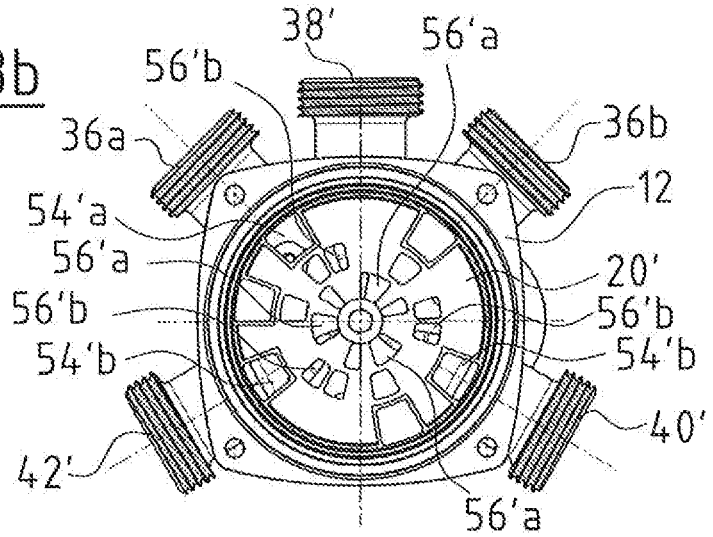
FIG. 13*b* is a view according to FIGS. 12*a* to 12*c* for one of three different switching positions, in which two outlets are opened.
Figure 13C:
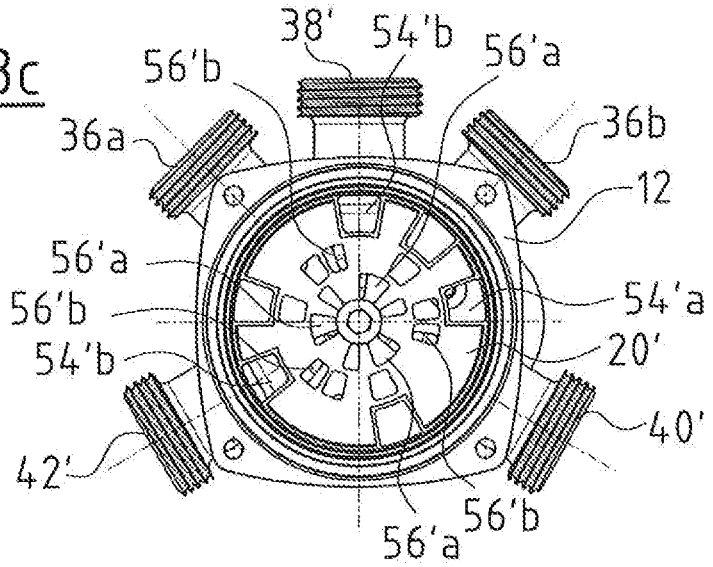
FIG. 13*c* is a view according to FIGS. 12*a* to 12*c* for one of three different switching positions, in which two outlets are opened.

In each case, two of the three delivery branches 38', 40' and 42' are opened in the three further switching positions which are described according to FIG. 13*a*, FIG. 13*b* and FIG. 13*c*. For this, two further delivery-side switching openings 54'*b* in the base of the lower part 20' of the valve element 18' are used. These two switching openings 54'*b* are distanced to one another by 120°, wherein no switching opening is provided at the third associated position distanced by 120°, so that one of the delivery-side branch openings 50 is covered and closed in each case. In the switching position according to FIG. 13*a*, the two delivery-side switching openings 54'*b* overlap the delivery-side branch openings 50 of the delivery branches 38' and 40'. The valve element 18' is rotated by 120° in the switching position according to FIG. 13*b*, so that the delivery branches 40' and 42' are opened in the corresponding manner by way of the switching openings 54'*b* overlapping the associated branch openings 50. The third possible switching position is shown in FIG. 13*c*, where the delivery branches 38' and 42' are simultaneously opened, whilst the third delivery branch 40' is closed. The mixing ratio of the flows from the two suction branches 36*a* and 36*b* can also be changed in these three switching positions by way of a slight change of the angular position about the reached switching position, by way of the suction-side branch openings 48*a* and 48*b* being brought to overlap with the suction-side switching openings 56'*a* and 56'*b* to a different extent. The change of the positioning in its angle here is significantly smaller that the change of the switching position.

Figure 14A:
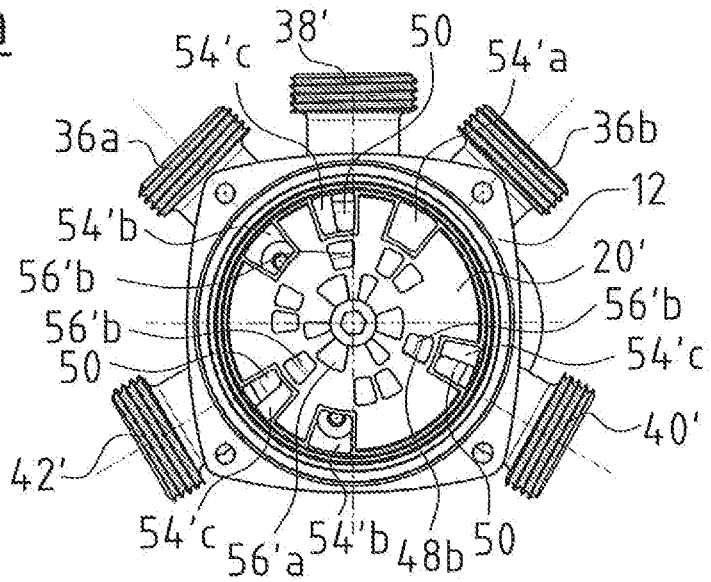
FIG. 14*a* is a view according to FIGS. 12 and 13 for a switching position, at which three outlets are opened at one of three different positionings of the valve element.
Figure 14B:
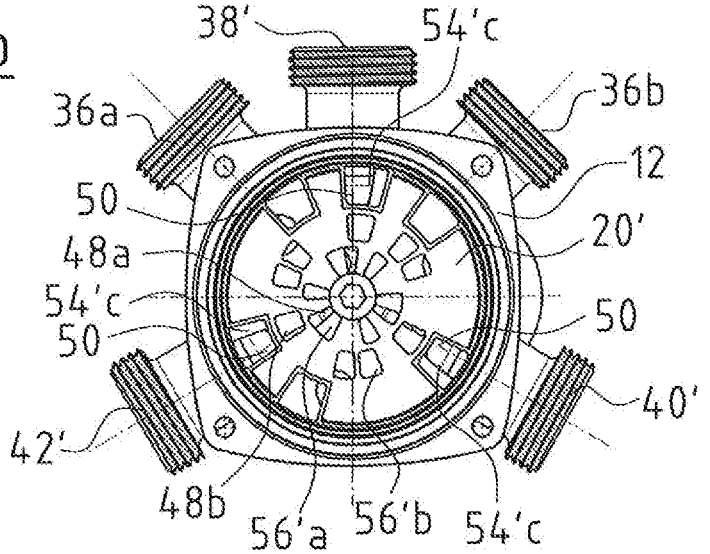
FIG. 14*b* is a view according to FIGS. 12 and 13 for a switching position, at which three outlets are opened at one of three different positionings of the valve element.
Figure 14C:
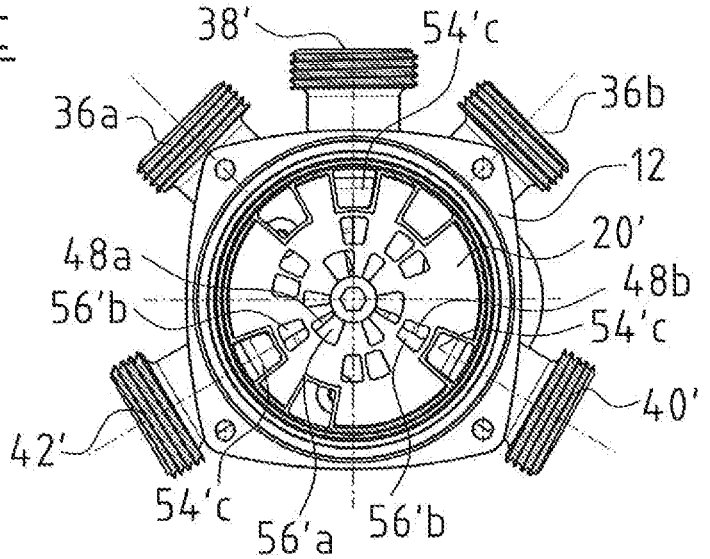
FIG. 14*c* is a view according to FIGS. 12 and 13 for a switching position, at which three outlets are opened at one of three different positionings of the valve element.

A further possible switching position, in which all three delivery branches 38' 40', 42' are opened is described by way of FIGS. 14*a* to 14*c*. For this, three delivery-side switching openings 54'*c* in the base of the lower part 20' of the valve element 18' are applied, and these are distanced to one another by 120°. In this switching position, the previously described delivery-side switching openings 54 are placed such that they lie opposite none of the delivery-side branch openings 50, as is characterized in FIG. 14*a*. In the switching position according to FIGS. 14*a* to 14*c*, the delivery-side switching openings 54'*c* in each case lie opposite one of the delivery-side branch openings 50, wherein these at least partly overlap. FIG. 14*c* shows exactly the middle of the switching position, in which the switching openings 54'*c* cover the delivery-side branch openings 50 in a precise manner. FIGS. 14*a* and 14*b* shows positionings which differ slightly from this in two opposite rotation directions, in which positionings the mixing ratio at the suction side is changed in the previously described manner. In these positions, the delivery-side switching openings 54'*c* only partly overlap the delivery-side branch openings 50. In the first positioning according to FIG. 14*a*, only the suction-side switching openings 56'*b* overlap with the oppositely lying suction-side branch openings 48*b*. In contrast, the suction-side branch openings 48 which lie radially inwards are completely closed. In this position, fluid is only sucked from the suction branch 36*b*. The positionings according to FIG. 14*b* and FIG. 14*c* result in different overlappings of the branch openings 48*a* and 48*b* with the suction-side switching openings 56'*a* and 56'*b*, said different overlappings representing different mixing ratios.

Figure 15:
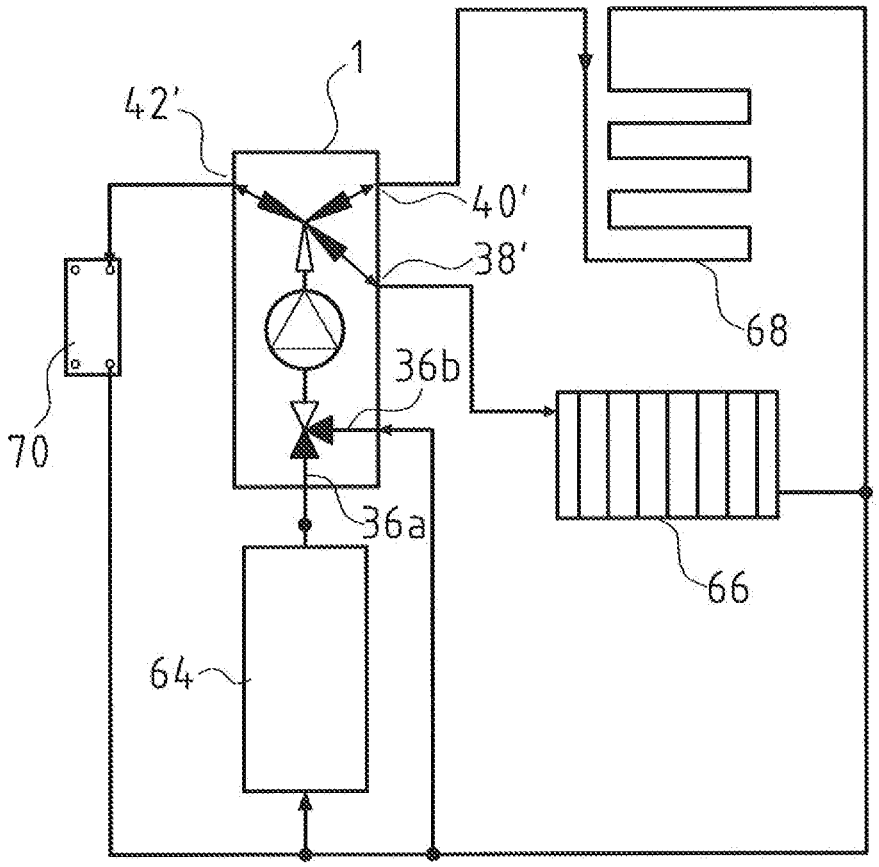
FIG. 15 is a schematic hydraulic circuit diagram for a heating facility with a pump assembly according to the second embodiment.
Figure 16:
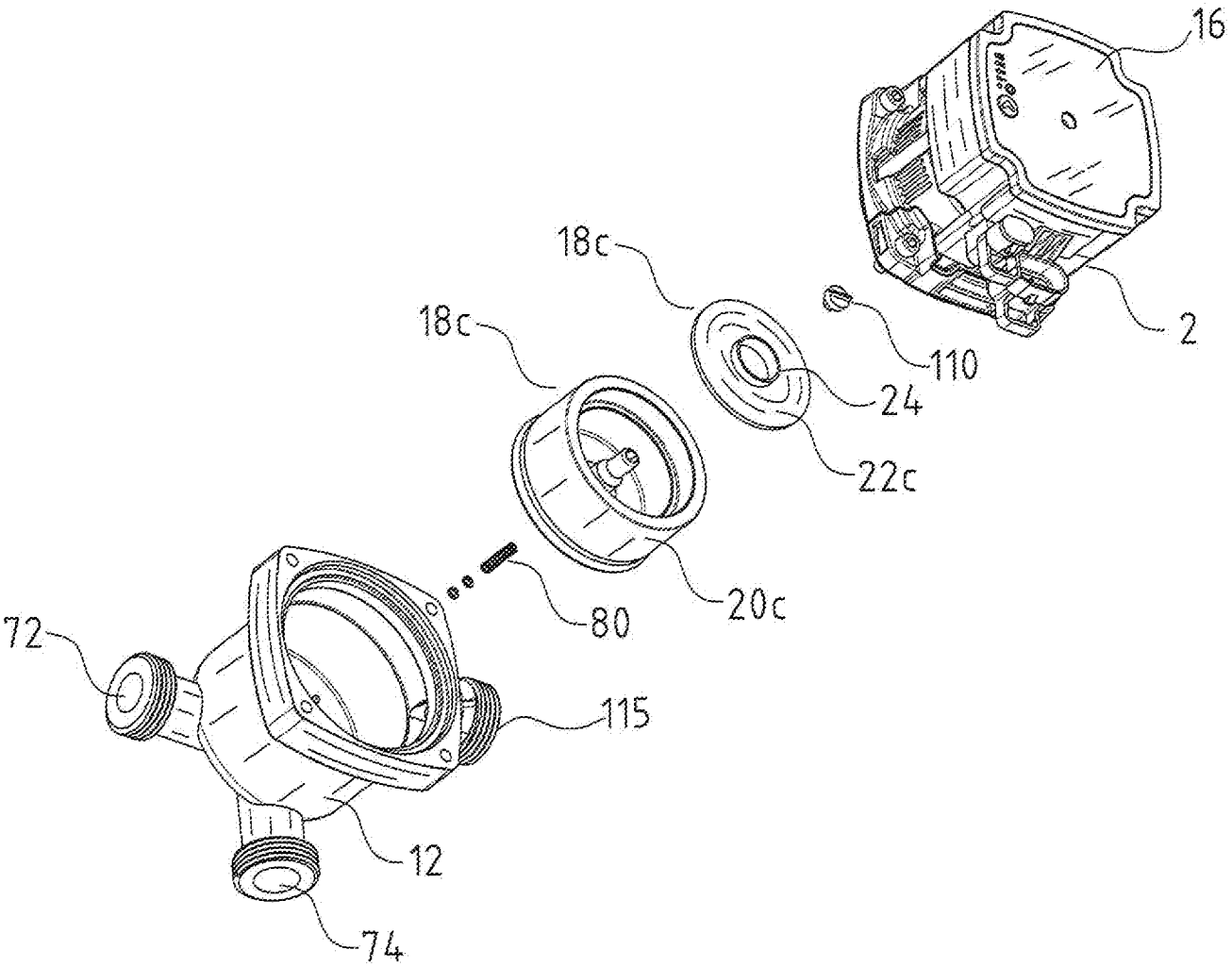
FIG. 16 is a perspective exploded view of a pump assembly according to a third embodiment of the invention.
Figure 17:
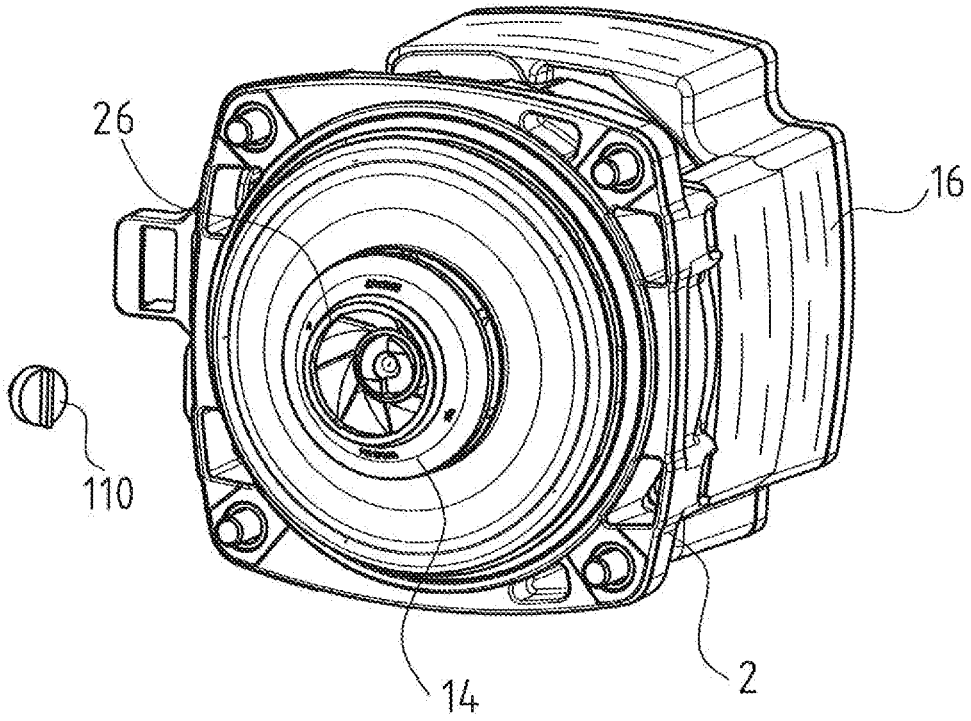
FIG. 17 is a perspective view of the pump assembly according to FIG. 16 with a removed pump casing and valve element.
Figure 18:
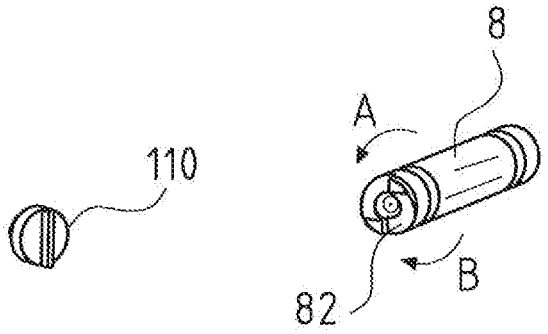
FIG. 18 is a perspective view of the motor shaft of the pump assembly according to FIGS. 16 and 17 as well as of the coupling part of the valve element.

A pump assembly 1 according to the second embodiment example can be applied for example in a heating facility which is shown in FIG. 15. The heating facility comprises a heat source 64 which can be a gas heating boiler for example. Moreover, there are two heating circuits 66 and 68, of which the heating circuit 68 is a floor heating circuit which is operated at a lower temperature. A secondary heat exchanger 70 is yet further provided for heating service water. The first suction branch 36*a* of the pump assembly 1 is connected to the outlet of the heat source 64. The second suction branch 36*b* is connected to the return of the heating circuits 66, 68 and of the secondary heat exchanger 70 and hence feeds cooled water to the suction branch 36*b*, whereas heated water is fed to the suction branch 36*a*. These two fluid flows can be mixed in the described manner. The first heating circuit 66 is connected to the delivery branch 38', the second heating circuit 68 to the delivery branch 40' and the secondary heat exchanger 70 to the delivery branch 42'. One can therefore switch between these three heating circuits, wherein two or all three can be operated in parallel in the described manner. A temperature adaptation is simultaneously possible by way of the mixing.

With regard to the third embodiment according to FIGS. 16 to 22, a mixing valve as can be used for example for temperature adjustment for a floor heating is integrated in the pump casing 12.

Figure 20:
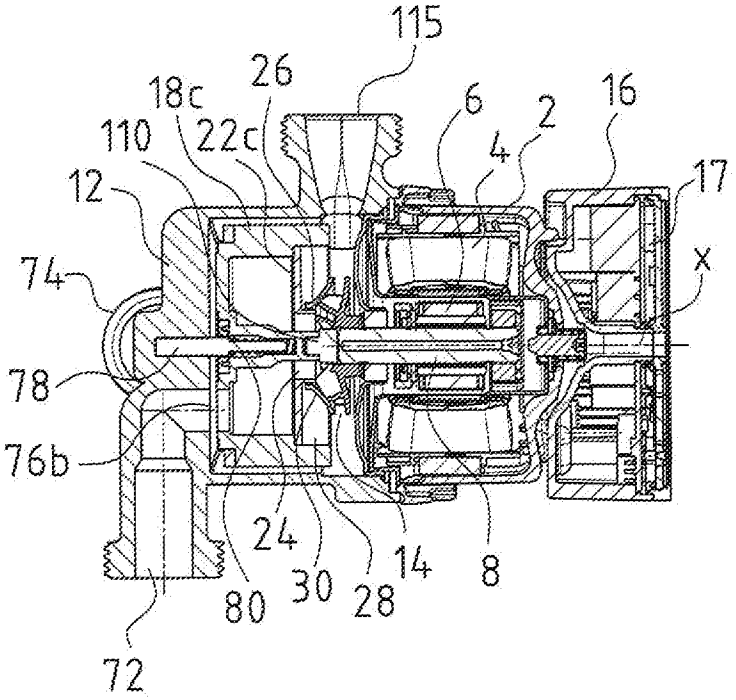
FIG. 20 is a sectioned view according to FIG. 19 with the valve element in a second position.
Figure 19:
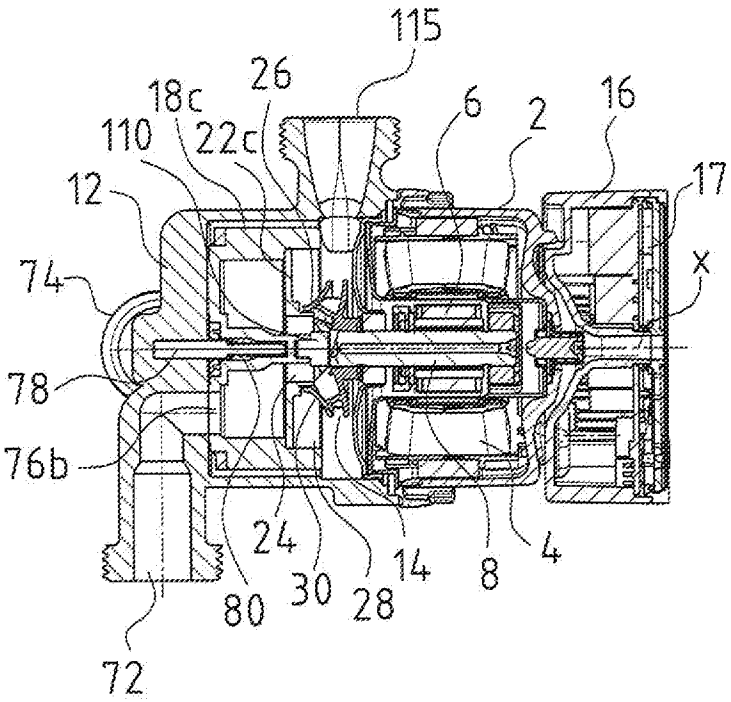
FIG. 19 is a sectioned view of the centrifugal pump assembly according to FIG. 16 with the valve element in a first position.

The motor casing 2 with the electronics casing 16 corresponds to the previously described embodiment. The pump casing 12 comprises two suction branches 72, 74 which in the inside each end at a suction-side branch opening 76 (76*a* and 76*b*). Concerning this third embodiment, the valve element 18*c* is likewise configured in a drum-like manner and consists of a pot-like lower part 20*c* which at its side which faces the impeller 14 is closed by a cover 22*c*. A suction opening 36 is formed in the central region of the cover 22*c*. The valve element 18*c* is rotatably mounted on a pivot 78 which is arranged in the base of the pump casing 12. Here, the rotation axis of the valve element 18*c* corresponds to the rotation axis X of the rotor shaft 8, as is the case with the examples described above. Here, the valve element 18*c* is likewise axially displaceable along the axis X and is pressed by a spring 80 into the idle position which is shown in FIG. 20 and in which the valve element 18*c* is located in released position, in which the lower part 20*c* does not bear on the base of the pump casing 12, so that the valve element 18*c* is essentially freely rotatable about the pivot 78. In the released position, the face end of the rotor shaft 8 which is configured as a coupling 82 functions as an axial stop. The coupling 82 engages with a counter coupling 110 which is arranged on the valve element 18*c* in a rotationally fixed manner. The coupling 82 comprises inclined (beveled) coupling surfaces which along a peripheral line essentially describe a saw-toothed profile in a manner such that a torque transmission from the coupling 82 onto the counter coupling 110 is only possible in one rotation direction, specifically in the rotation direction A in FIG. 18. In contrast, the coupling slips through in the opposite rotation direction B, wherein an axial movement of the valve element 18*c* occurs. The rotation direction B is that rotation direction, in which the pump assembly is driven in normal operation. In contrast, the rotation direction A is used for the targeted actuation of the valve element 18*c*. This means that a rotation-direction-dependent coupling is formed here. However, concerning this embodiment too, the counter-coupling 110 also disengages from the coupling 82 due to the pressure in the delivery chamber 28. If the pressure in the delivery chamber 28 increases, then a pressing force which is opposed to the spring force of the spring 80 and which exceeds this acts upon the cover 22*c* as a pressure surface, so that the valve element 18*c* is pressed into the bearing position as is shown in FIG. 19. In this position, the lower part 20*c* bears on the base side of the pump casing 12, so that on the one hand the valve element 18*c* is non-positively held and on the other hand a sealed bearing contact is achieved, said bearing contact sealing the delivery side and the suction side with respect to one another, in the subsequently described manner.

Figure 21C:
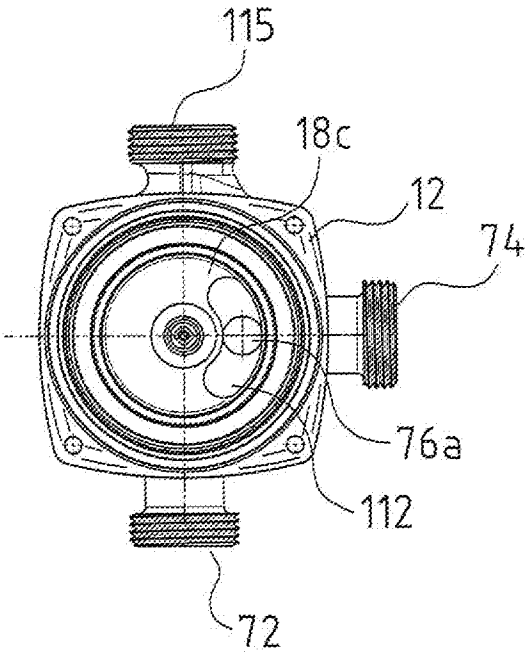
FIG. 21*c* is a plan view of the opened pump casing of the centrifugal pump assembly according to FIGS. 16 to 20, with the valve element in one of three different switching positions.
Figure 21B:
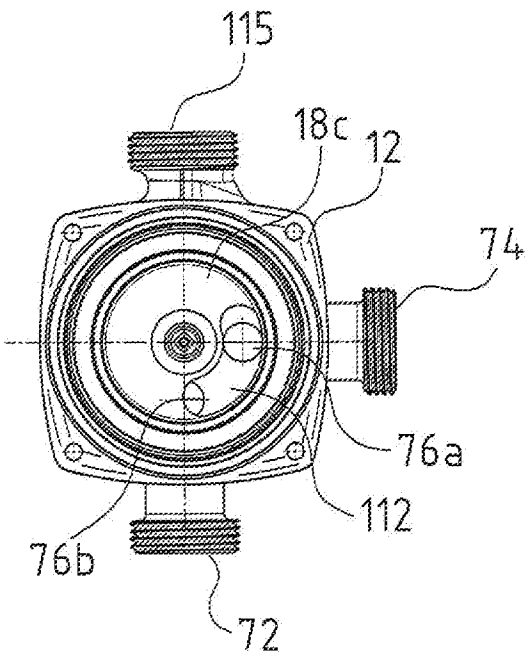
FIG. 21*b* is a plan view of the opened pump casing of the centrifugal pump assembly according to FIGS. 16 to 20, with the valve element in one of three different switching positions.
Figure 21A:
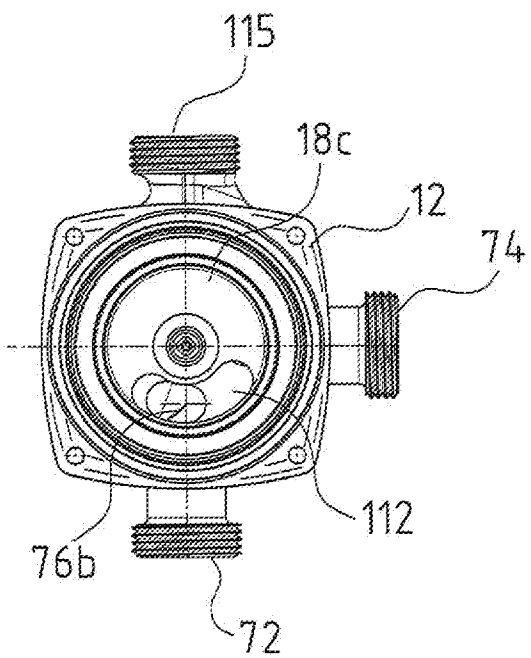
FIG. 21*a* is a plan view of the opened pump casing of the centrifugal pump assembly according to FIGS. 16 to 20, with the valve element in one of three different switching positions.

The pump casing 12 comprises two suction branches 72 and 74, of which the suction branch 72 runs out in a suction-side branch opening 76*a* and the suction branch 74 in a suction-side branch opening 76*b*, in the base of the pump casing 12 into the interior of this, which is to say into the suction chamber. The lower part 20*c* of the valve element 18*c* in its base comprises an arched switching opening or opening 112 which extends essentially over 90°. FIG. 21*a* shows a first switching position, in which the opening 112 only overlaps the branch opening 76*b*, so that a flow path is only given from the suction branch 72 to the suction opening 24 and therefore to the suction port 26 of the impeller 14. The second branch opening 76*a* is sealingly closed by the base of the valve element 18*c* which bears in the peripheral region of this second branch opening. FIG. 21*c* shows the second switching position, in which the opening 112 only overlaps the branch opening 76*a*, whilst the branch opening 76*b* is closed. In this switching position, only a flow path from the suction branch 74 to the suction port 26 is opened. FIG. 21*b* now shows an intermediate position, in which the opening 112 overlaps both branch openings 76*a* and 76*b*, wherein the branch opening 76*b* is only partly released. A mixing ratio between the flows from the branch openings 76*a* and 76*b* can be changed by way of changing the degree of release of the branch opening 76*b*. The valve element 18*c* can also be actuated in small steps via the stepwise actuation of the rotor shaft 8, in order to change the mixing ratio.

Such a stepwise actuating of the rotor shaft 8 can be initiated in a special operating mode by the control device 17 in the electronics casing 16. This means that one makes do without separate actuating motor. The drive motor is operated in an open-loop operation in this special operating mode, wherein it can be activated in a manner such that it can be rotated in a stepwise manner into desired angular positions. The necessary angular positions for adjusting the desired mixing ratios can be moved to in a targeted manner by way of this, wherein a closed-loop control could be effected via an outlet-side temperature sensor which is not shown here.

Figure 22:
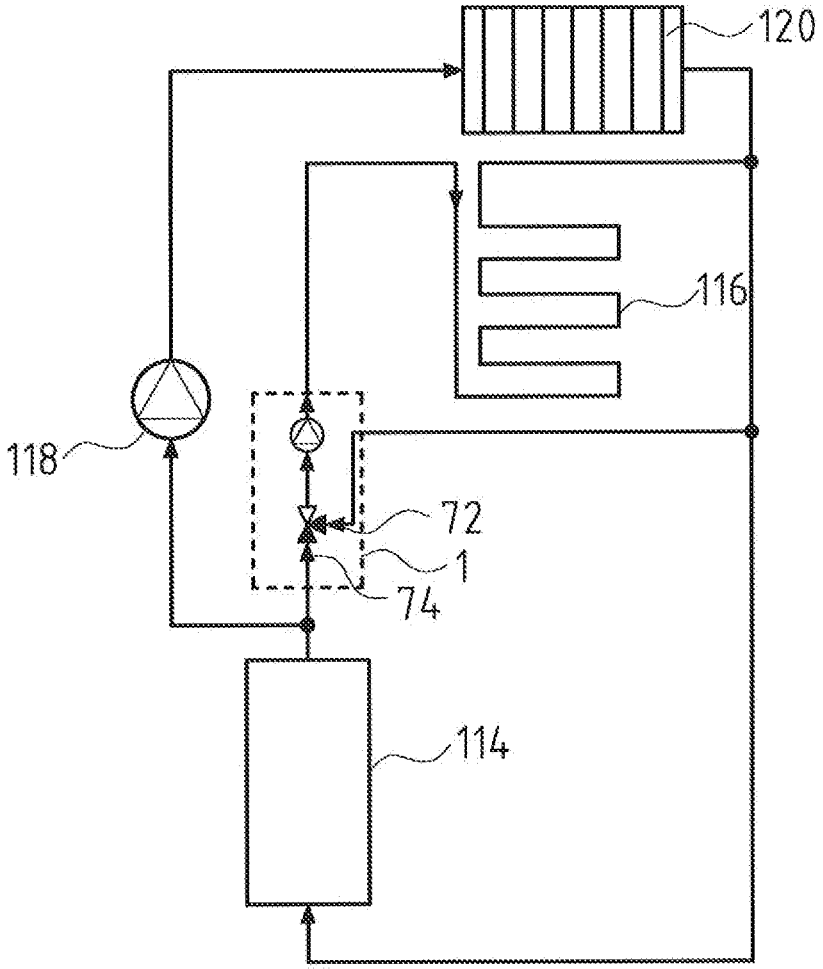
FIG. 22 is a schematic view showing the hydraulic construction of a heating facility with a pump assembly according to FIGS. 16 to 21.
Figure 23:
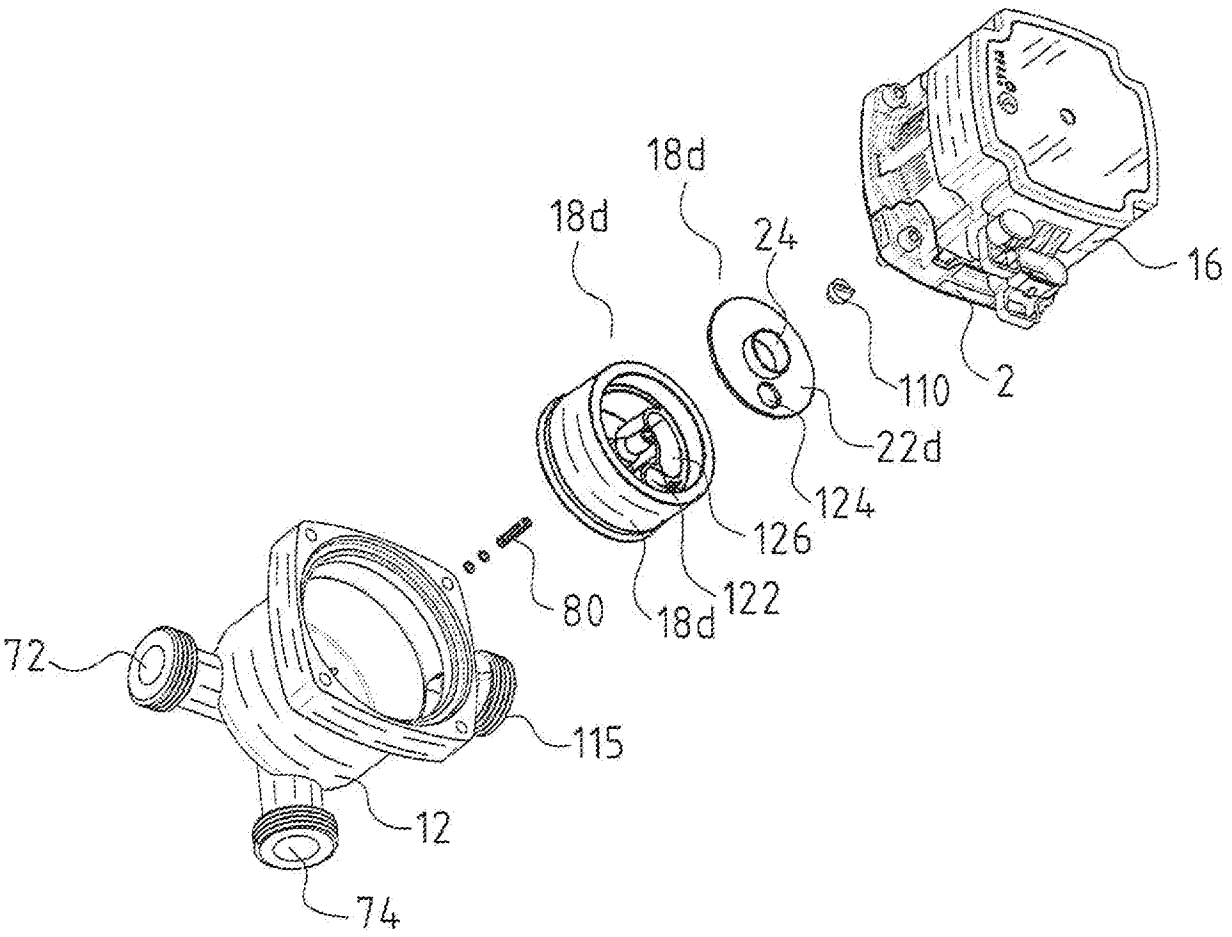
FIG. 23 is an exploded view of a pump assembly according to a fourth embodiment of the invention.
Figure 24:
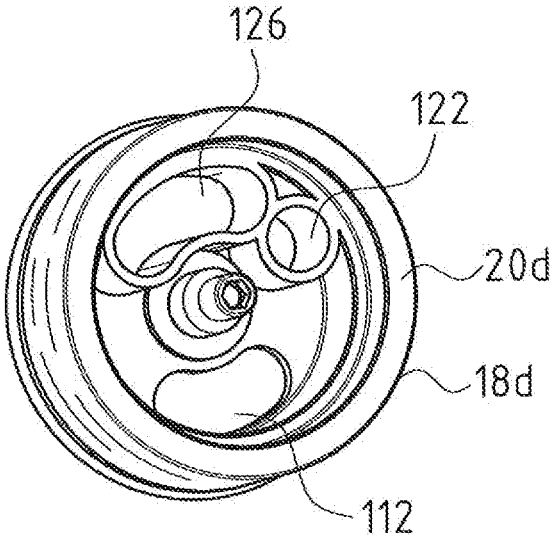
FIG. 24 is a perspective view of the opened valve element of the pump assembly according to FIG. 23.
Figure 25:
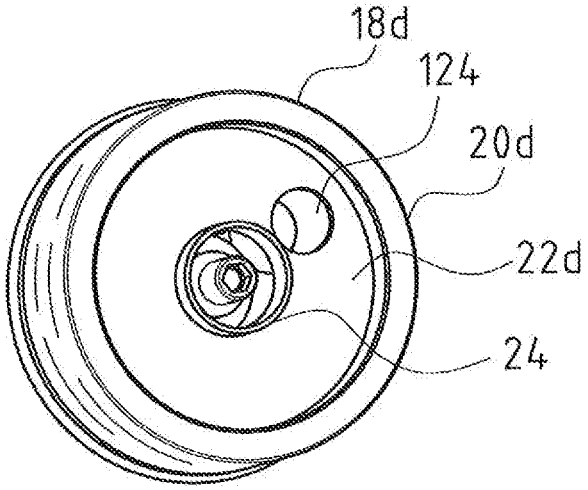
FIG. 25 is a perspective view of the closed valve element according to FIG. 24.
Figure 27:
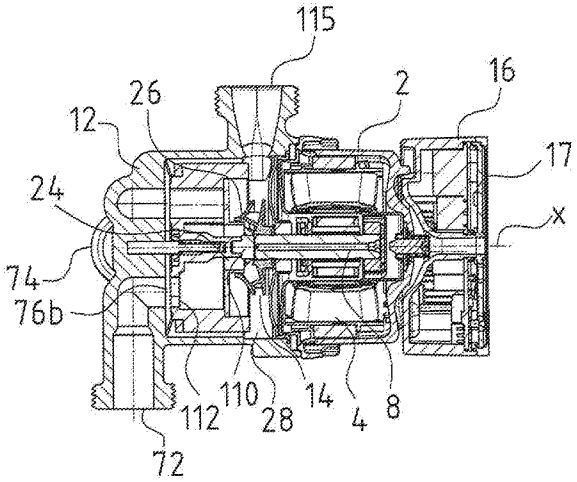
FIG. 27 is a sectional view according to FIG. 26 with the valve element in a second position.
Figure 26:
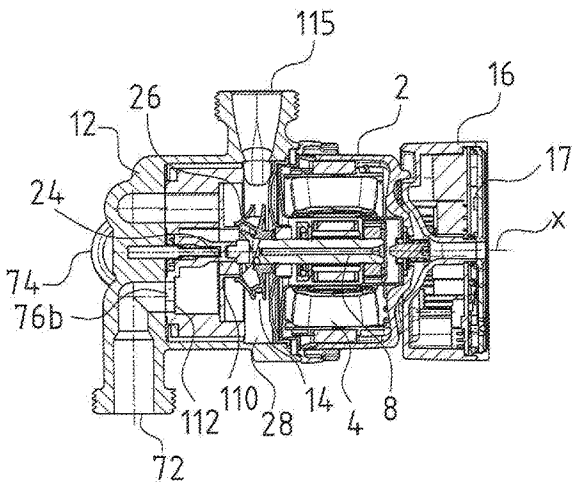
FIG. 26 is a sectioned view of the pump assembly according to FIG. 23 with the valve element in a first position.

Such a functionality can be applied for example in a hydraulic system as is shown in FIG. 22. There, the centrifugal pump assembly with the integrated valve as has been described above is characterized by the dashed line 1. The hydraulic circuit comprises a heat source 114 in the form of a gas heating boiler for example, the outlet of which running out for example into the suction branch 74 of the pump casing 12. In this example, a floor heating circuit 116 whose return is connected to the inlet of the heat source 114 as well as to the suction branch 72 of the centrifugal pump assembly 1 connects onto the delivery branch 115 of the centrifugal pump assembly 1. A further heating circuit 120 can be supplied with a heat transfer medium which has the outlet-side temperature of the heat source 114, via a second centrifugal pump assembly 118. The floor heating circuit 116 in contrast can be regulated in its feed temperature in a manner such that cold water from the return is admixed to the hot water at the outlet side of the heat source 114, wherein the mixing ratio can be changed by way of changing the opening ratios of the suction-side branch openings 76*a* and 76*b* in the manner described above by way of rotating the valve element 18*c*.

In this embodiment example too, the impeller 14 comprises a shroud 30, so that a separation between the delivery chamber 28 and the suction region of the pump assembly is given, wherein the surface of the cover 22*c*, as the pressure surface, faces the delivery chamber 28. Here too, the suction opening 24 is sealingly engaged with the suction port 26.

The fourth embodiment example according to FIGS. 23 to 29 shows a pump assembly or centrifugal pump assembly which additionally to the previously described mixing functionality in the third embodiment example yet comprises a switch-over functionality for the additional supply of a secondary heat exchanger for the heating of service water.

Concerning this embodiment, the mounting and drive of the valve element 18*d* is effected just as with the third embodiment. In contrast to the valve element 18*c*, the valve element 18*d* additionally to the opening 112 comprises a through-channel 122 which extends from an opening 124 in the cover 22*d* to an opening in the base of the lower part 20*d* and therefore connects the two axial ends of the valve element 18*d* to one another. An arched bridging opening 126 is moreover yet formed in the valve element 18*d* and this opening is closed to the delivery chamber 26 by the cover 22*d* and is only open to the lower side, which is to say to the base of the lower part 20*d* and thus to the suction chamber.

Figure 28B:
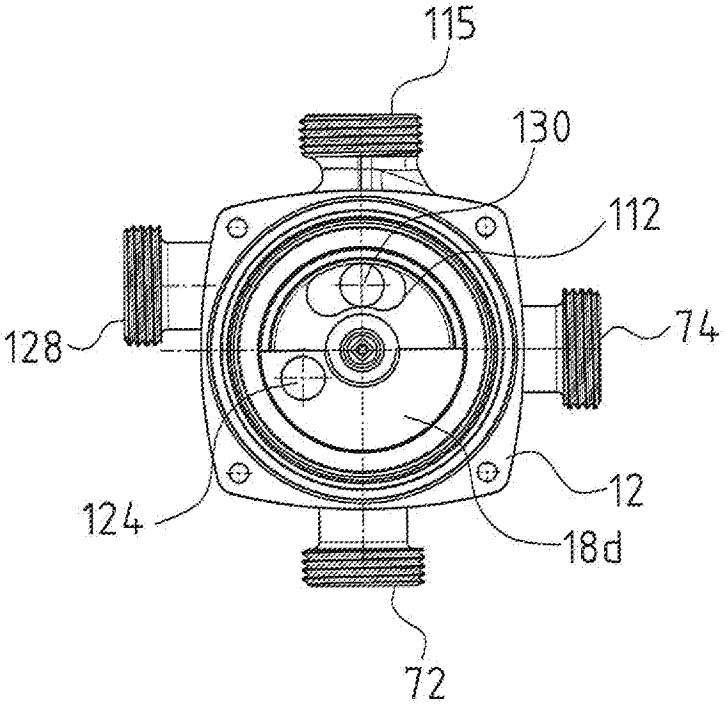
FIG. 28*b* is a plan view of the opened pump casing of the pump assembly according to FIGS. 23 to 27 with the valve element in one of four different switching positions.
Figure 28A:
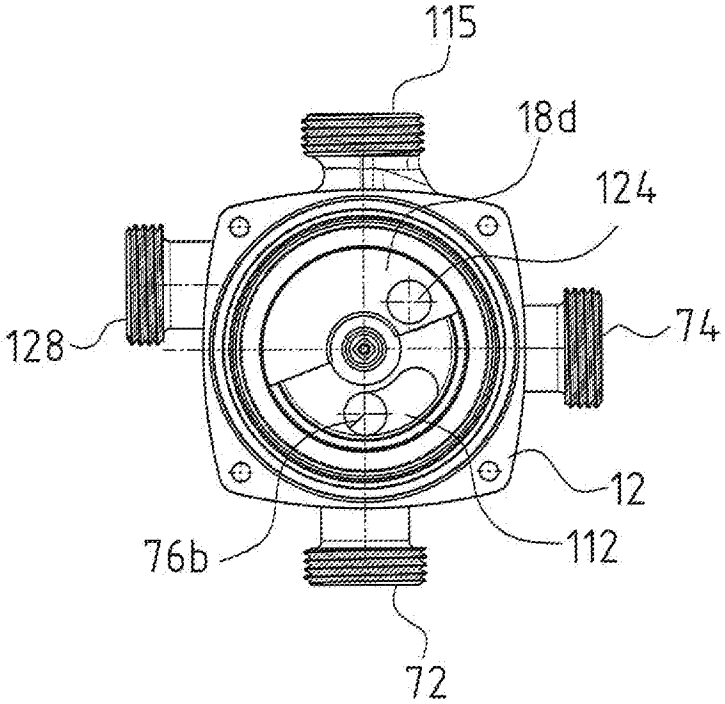
FIG. 28*a* is a plan view of the opened pump casing of the pump assembly according to FIGS. 23 to 27 with the valve element in one of four different switching positions.

Apart from the delivery branch 115 and both previously described suction branches 74 and 72, the pump casing 12 comprises a further branch 128. The branch 128 runs out into the suction chamber, in a branch opening or an inlet 130 in the base of the pump casing 12 additionally to the branch openings 76*a* and 76*b*. The various switching positions are explained by way of FIGS. 28*a* to 28*d*, wherein the cover 22*d* of the valve element 18*d* is shown in a partly opened manner in these figures, in order to clarify the position of the openings which lie therebelow. FIG. 28*a* shows a first switching position, in which the opening 112 lies opposite the branch opening 76*b*, so that a flow connection from the suction branch 12 to the suction port 26 of the impeller 14 is created. In the switching position according to FIG. 28*b*, the opening 112 lies over the inlet 130, so that a flow connection from the branch 128 to the suction opening 24 and via this into the suction port 26 of the impeller 14 is created. In a further switching position which is shown in FIG. 28*c*, the opening 112 lies over the branch opening 76*b*, so that again a flow connection from the suction branch 72 to the suction port 26 of the impeller 14 is given. A partial overlapping of the switching opening or opening 124 and of the through-hole 122 with the inlet 76*a* simultaneously takes place, so that a connection between the delivery chamber 28 and the suction branch 74 which functions here as a delivery branch is created. The bridging opening 126 simultaneously overlaps the inlet 130 and a part of the inlet 76*a*, so that a connection from the branch 128 to the branch 74 is likewise created via the inlet 130, the bridging opening 126 and the inlet 76*a*.

Figure 28D:
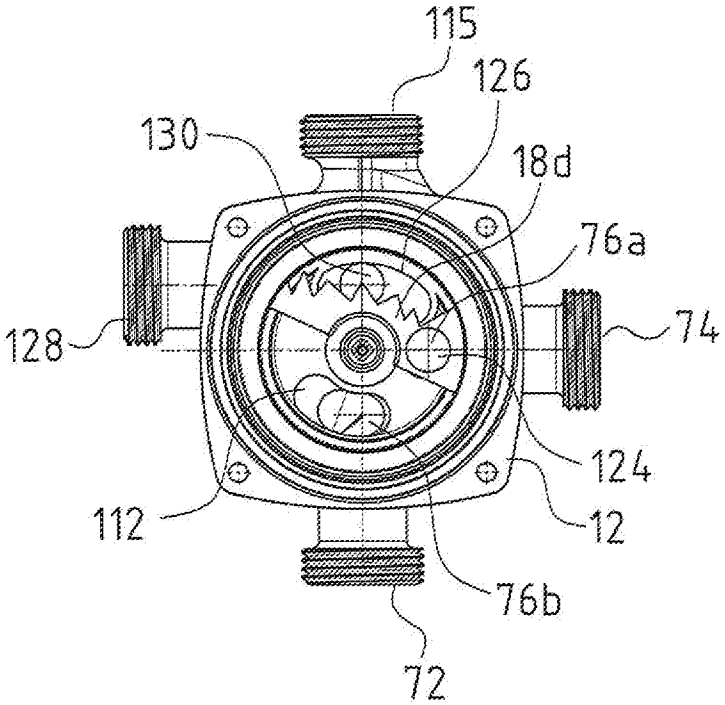
FIG. 28*d* is a plan view of the opened pump casing of the pump assembly according to FIGS. 23 to 27 with the valve element in one of four different switching positions.
Figure 28C:
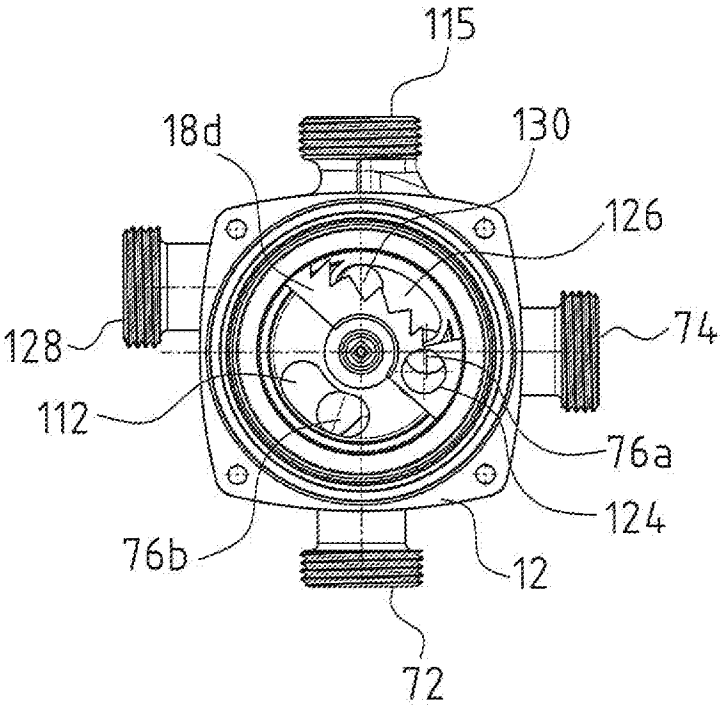
FIG. 28*c* is a plan view of the opened pump casing of the pump assembly according to FIGS. 23 to 27 with the valve element in one of four different switching positions.

FIG. 28*d* shows a fourth switching position, in which the through-channel 122 completely overlaps the inlet 76*a*, so that the branch 74 is connected to the delivery chamber 28 via the through-channel 122 and the opening 124. Simultaneously, the bridging opening 126 now only covers the inlet 130. The opening 112 continues to cover the inlet 76*b*.

Figure 29:
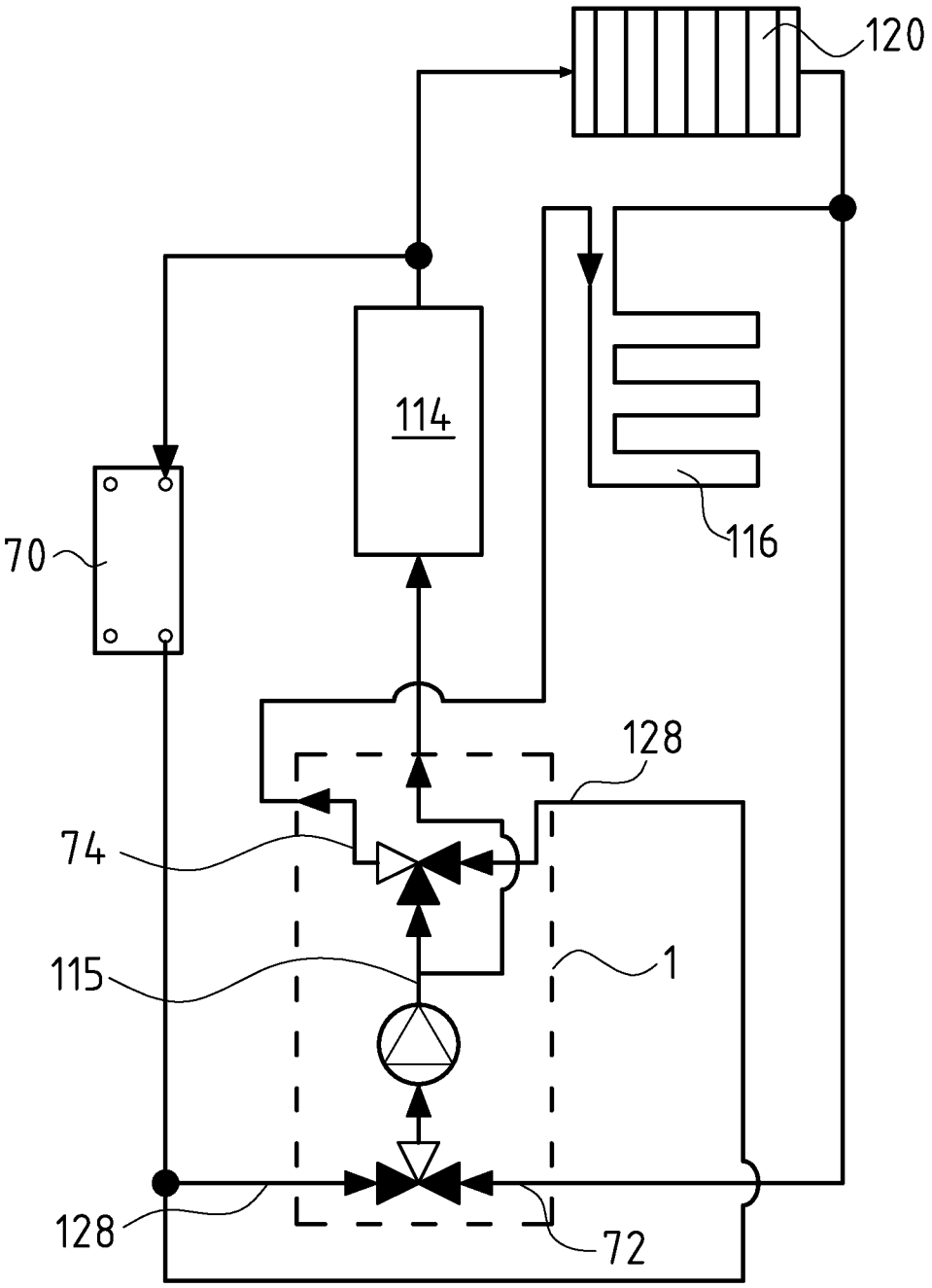
FIG. 29 is a schematic view showing the hydraulic construction of a heating facility with a pump assembly according to FIGS. 23 to 28.

Such a centrifugal pump assembly can be applied for example in a heating system as is shown in FIG. 29. Here, the dashed line delimits the centrifugal pump assembly 1, as has just been described by way of FIGS. 23 to 28. The heating system again comprises a primary heat exchanger or a heat source 114 which for example can be gas heating boiler. At the outlet side, the flow path runs into a first heating circuit 120 which can be formed for example by way of conventional radiators. A flow path simultaneously branches to a secondary heat exchanger 70 for heating service water. The heating system moreover comprises a floor heating circuit 116. The returns of the heating circuit 120 and of the floor heating circuit 116 run out into the suction branch 72 on the pump casing 12. The return from the secondary heat exchanger 70 runs out into the branch 128 which provides two functionalities as is described hereinafter. The branch 74 of the pump casing 12 is connected to the feed of the floor heating circuit 116.

When the valve element 18*d* is located in the first switching position represented in FIG. 28*a*, the impeller 14 delivers fluid out of the suction branch 72 via the delivery branch 115 through the heat source 140 and to the heating circuit 120 and back to the suction branch 72. If the valve element 18*d* is located in the second switching position which is shown in FIG. 28*b*, the facility is switched over to service water operation and in this condition the pump assembly or the impeller 14 delivers fluid from the branch 128 which serves as a suction branch, through the delivery branch 115, via the heat source 114 through the secondary heat exchanger 70 and back to the branch 128. The floor heating circuit 116 is additionally supplied if the valve element 18*d* is located in the third switching position which is shown in FIG. 28*c*. The water flows into the suction port 26 of the impeller 14 via the suction branch 72 and is delivered via the delivery branch 115 through the first heating circuit 120 via the heat source 114 in the described manner. The fluid at the outlet side of the impeller 14 simultaneously exits the delivery chamber 28 into the opening 124 and through the through-channel 122 and thus flows to the branch 74 and via this into the floor heating circuit 116.

Fluid simultaneously flows via the bridging opening 126 into the branch 74 via the branch 128 and the inlet 130, in the switching position which is shown in FIG. 28*c*. This means that here water flows via the heat source 114 through the secondary heat exchanger 70 and the branch 128 to the branch 74. Since essentially no heat is taken at the secondary heat exchanger 70 in this heating operation, hot water is admixed to the branch 74 additionally to the cold water which flows out of the delivery chamber 28 to the branch 74 via the through-channel 122. The quantity of the admixed warm water at the branch 74 can be varied by way of changing the degree of opening via the valve position 18*d*. FIG. 28*d* shows a switching position, in which the admixing is switched off and the branch 74 is exclusively in direct connection with the delivery chamber 28. In this condition, the water in the floor heating circuit 116 is delivered in the circuit without any supply of heat. It is to be recognized that with this embodiment, a switching between the heating and service water heating as well as simultaneously the supply of two heating circuits with different temperatures, specifically of a first heating circuit 120 with the exit temperature of the heat source 114 and of a floor heating circuit 116 with a temperature which is reduced via a mixing function, can also be achieved by way of the change of the switching positions of the valve element 18*d*. Here, the rotation or actuation of the valve element 18*d* is effected via the drive motor of the pump assembly in the same manner as is described by way of the third embodiment example.

It is to be understood that the various previously described embodiments can be combined with one another in a different manner. Thus the different described drive modes of the valve element can be essentially arbitrarily combined with different geometric configurations of the valve element as have likewise been described above. The different valve functionalities (for example mixing and switching-over) can likewise be realized and combined with different drive modes. These different combination possibilities which are to be derived from the preceding embodiment examples, inasmuch as this is concerned are expressly encompassed by the invention. Concerning the shown embodiment examples, the pump casing with the casing, in which the valve element is arranged, is configured as a single part or single piece. It is to be understood that a multi-part construction is possible in a corresponding manner. Moreover, a casing which is separate from the pump casing and which is connected to the pump casing via a delivery connection and a suction connection could also be provided for the valve element.

While specific embodiments of the invention have been shown and described in detail to illustrate the application of the principles of the invention, it will be understood that the invention may be embodied otherwise without departing from such principles.

The invention claimed is:

1. A pump assembly comprising:

at least one rotatingly driven impeller and with at least one valve element rotatable about a rotation axis between at least two switching positions, wherein the valve element comprises a first face side which extends transversely to the rotation axis of said valve element, a suction opening which is engaged with a suction port of the impeller and is formed in the first face side in a central region and the first face side comprises a pressure surface which surrounds the suction opening and which is adjacent to a delivery chamber which surrounds the impeller;

two branch openings, wherein the valve element lies opposite the two branch openings and an inside of the valve element comprises at least one connection which depending on a positioning or a switching position of the valve element, selectively connects one of the branch openings to the suction opening or selectively connects one of the branch openings to a pressure opening in the pressure surface or connects the two branch openings to one another;

wherein the two branch openings axially face a second face side of the valve element with respect to a direction of the rotation axis, the second face side facing away from the first face side in the direction of the rotation axis.

2. The pump assembly according to claim 1, wherein the rotation axis of the valve element lies aligned to a rotation axis of the impeller.

3. The pump assembly according to claim 1, wherein the impeller is closed at the first face side by a shroud surrounding the suction port, and a peripheral edge of the suction port is sealingly engaged with a peripheral edge of the suction opening.

4. The pump assembly according to claim 1, further comprising at least one delivery branch, wherein said pressure opening is flow-connected to the at least one delivery branch of the pump assembly in at least one of the switching positions of the valve element.

5. The pump assembly according to claim 1, wherein the valve element is configured with a drum form comprising a peripheral wall which extends annularly about the rotation axis, with the first face side and with the second face side which is away from the first face side in the direction of the rotation axis, by way of which face sides the peripheral wall is closed.

6. The pump assembly according to claim 1, wherein the suction opening via a connection in the inside of the valve element is connected to at least one suction-side switching opening, said suction-side switching opening being in the valve element and arranged such that the suction-side switching opening can be brought to overlap with two suction-side branch openings to a different extent depending on a positioning of the valve element.

7. The pump assembly according to claim 6, wherein the at least two suction-side switching openings are radially distanced to the rotation axis of the valve element to a different extent.

8. The pump assembly according to claim 1, wherein the pressure opening is formed in the pressure surface of the valve element, said pressure opening via a connection in the valve element inside of the valve element being connected to one or more delivery-side switching openings which are arranged in a manner such that they can each be brought to overlap with a delivery-side branch opening depending on the switching position of the valve element.

9. The pump assembly according to claim 8, wherein the delivery-side switching openings are distanced radially further to the rotation axis of the valve element than a suction-side switching opening.

10. The pump assembly according to claim 8, wherein several delivery-side branch openings and several delivery-side switching openings are arranged such that in a first switching position of the valve element, only one delivery-side switching opening lies opposite a delivery-side branch opening and in at least one second switching position at least two delivery-side switching openings each lie opposite a delivery-side branch opening.

11. The pump assembly according to claim 10, wherein the delivery-side switching openings and the delivery-side branch openings are arranged such that in each case in a special switching position of the valve element, each of the delivery-side branch openings individually lies opposite one of the delivery-side switching openings and in at least one further switching position, simultaneously several of the delivery-side branch openings lie opposite one of the delivery-side switching openings.

12. The pump assembly according to claim 8, wherein suction-side switching openings are arranged such that in each of the switching positions of the valve element, in which one or more of the delivery-side switching openings lie opposite one of the delivery-side branch openings in each case, at least one suction-side switching opening lies opposite a suction-side branch opening, wherein a degree of overlapping of the suction-side switching opening with the at least one suction-side branch opening is varied by way of changing a positioning of the valve element within the switching position.

13. The pump assembly according to claim 12, wherein the suction-side switching openings are arranged such that at least one suction-side switching opening lies opposite two suction-side branch openings in each of the switching positions of the valve element, wherein a degree of overlapping of the at least one suction-side switching opening with the suction-side branch openings can be varied by way of changing the positioning of the valve element within the switching position.

14. The pump assembly according to claim 12, wherein the valve element is configured such that a change of the positioning of the valve element is effected by way of a rotation of this element in an angular range which is smaller than an angle region between the switching positions.

15. The pump assembly according to claim 12, wherein for movement of the valve element, the valve element is coupled to a rotor of a drive motor which drives the impeller, by way of a magnetic, mechanical and/or hydraulic coupling, or has an actuation motor configured as a stepper motor.

16. The pump assembly according to claim 1, wherein the valve element is configured and arranged such that rotation angles between the individual switching positions correspond to a fixed, uniform angular step or a multiple of a fixed angular step.

17. The pump assembly according to claim 1, wherein the valve element is mounted such that the valve element is linearly movable along the rotation axis between a bearing position, in which the valve element bears on at least one contact surface, and a released position, in which the valve element is distanced to the contact surface, wherein the contact surface is at least one sealing surface and at least one sealing surface which surrounds a branch opening.

18. A pump assembly comprising:

at least one rotatingly driven impeller and with at least one valve element rotatable about a rotation axis between at least two switching positions, wherein the valve element comprises a first face side which extends transversely to the rotation axis of said valve element, a suction opening which is engaged with a suction port of the impeller and is formed in the first face side in a central region and the first face side comprises a pressure surface which surrounds the suction opening and which is adjacent to a delivery chamber which surrounds the impeller;

two branch openings, wherein the valve element lies opposite the two branch openings and an inside of the valve element comprises at least one connection which depending on a positioning or a switching position of the valve element, selectively connects one of the branch openings to the suction opening or selectively connects one of the branch openings to a pressure opening in the pressure surface or connects the two branch openings to one another;

wherein the two branch openings lie opposite a second face side of the valve element, the second face side facing away from the first face side in a direction of the rotation axis, the second face side defining a delivery-side switching opening, the at least one valve element being rotatable to overlap the delivery-side switching opening with one of the two branch openings.

* * * * *